US010283040B2

(12) United States Patent
Hosoyachi et al.

(10) Patent No.: US 10,283,040 B2
(45) Date of Patent: May 7, 2019

(54) DATA SIGNAL LINE DRIVE CIRCUIT, DATA SIGNAL LINE DRIVE METHOD AND DISPLAY DEVICE

(71) Applicant: SHARP KABUSHIKI KAISHA, Osaka (JP)

(72) Inventors: Kohei Hosoyachi, Sakai (JP); Yuhichiroh Murakami, Sakai (JP); Yasushi Sasaki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 95 days.

(21) Appl. No.: 15/547,057

(22) PCT Filed: Jan. 27, 2016

(86) PCT No.: PCT/JP2016/052236
§ 371 (c)(1),
(2) Date: Jul. 27, 2017

(87) PCT Pub. No.: WO2016/125640
PCT Pub. Date: Aug. 11, 2016

(65) Prior Publication Data

US 2018/0012540 A1 Jan. 11, 2018

(30) Foreign Application Priority Data

Feb. 3, 2015 (JP) ..... 2015-019704

(51) Int. Cl.
*G09G 3/36* (2006.01)
*G09G 3/22* (2006.01)
*G09G 5/10* (2006.01)

(52) U.S. Cl.
CPC ..... *G09G 3/22* (2013.01); *G09G 3/3688* (2013.01); *G09G 5/10* (2013.01); *G09G 3/3614* (2013.01); *G09G 3/3648* (2013.01); *G09G 2310/0297* (2013.01); *G09G 2320/0223* (2013.01)

(58) Field of Classification Search
CPC ..... G09G 3/22; G09G 5/10; G09G 3/3688; G09G 2320/0223; G09G 3/3648; G09G 2310/0297; G09G 3/3614
See application file for complete search history.

(56) References Cited

U.S. PATENT DOCUMENTS

2002/0154110 A1* 10/2002 Anzai ..... G09G 3/3688 345/211
2004/0246214 A1 12/2004 Yu et al.
(Continued)

FOREIGN PATENT DOCUMENTS

JP H08-320670 A 12/1996
JP H10-148809 A 6/1998
(Continued)

*Primary Examiner* — Ibrahim A Khan
(74) *Attorney, Agent, or Firm* — ScienBiziP, P.C.

(57) ABSTRACT

The present invention reliably and sufficiently corrects a voltage variation in data signal lines in a display device resulting when sampling analog video signals, while suppressing increase in layout area. In a data signal line drive circuit of an active matrix liquid crystal display device, a video signal Svi is sampled by an Nch transistor (SWk) which has a parasitic capacitance (Cgd) that causes a voltage drop in a data signal line SL3(i−1)+k (i=1 through n; k=1, 2, 3). To correct this, an inversion delayer (342) makes logical inversion of the transistor (SWk)'s control signal Sck and delays the inverted signal for a predetermined time to generate an inversion delayed signal Srdk, and applies this inversion delayed signal Srd to the data signal line 3(i−1)+k via a correction capacitance element (Cc). The inversion delayer (342) makes the inversion delayed signal Srdk start its change from an L level voltage to a H level voltage after the Nch transistor (SWk) has assumed an OFF state.

17 Claims, 29 Drawing Sheets

(56) References Cited

U.S. PATENT DOCUMENTS

| | | | | |
|---|---|---|---|---|
| 2004/0252116 | A1* | 12/2004 | Tobita | G02F 1/136213 345/211 |
| 2005/0134352 | A1* | 6/2005 | Yokoyama | G09G 3/3688 327/291 |
| 2006/0007723 | A1* | 1/2006 | Aoki | G09G 3/3614 365/98 |
| 2006/0061385 | A1* | 3/2006 | Jinta | G09G 3/3677 326/81 |
| 2008/0143650 | A1* | 6/2008 | Tomida | G09G 3/3233 345/76 |
| 2009/0102824 | A1 | 4/2009 | Tanaka et al. | |
| 2009/0167652 | A1* | 7/2009 | Yamamoto | G09G 3/3233 345/84 |
| 2009/0237345 | A1* | 9/2009 | Kamada | G09G 3/3611 345/94 |
| 2011/0012822 | A1* | 1/2011 | Park | G09G 3/3614 345/99 |
| 2015/0067392 | A1* | 3/2015 | Lim | G06F 1/12 714/15 |
| 2016/0042684 | A1* | 2/2016 | Kim | G11C 19/28 345/212 |
| 2018/0068615 | A1* | 3/2018 | Imai | G09G 3/3225 |

FOREIGN PATENT DOCUMENTS

| | | | |
|---|---|---|---|
| JP | 2003-58119 | A | 2/2003 |
| JP | 2003-195834 | A | 7/2003 |
| JP | 2004-350261 | A | 12/2004 |
| JP | 2005-55461 | A | 3/2005 |
| JP | 2011-17816 | A | 1/2011 |
| WO | 2007/105700 | A1 | 9/2007 |

* cited by examiner

DATA SIGNAL LINE DRIVE CIRCUIT, DATA SIGNAL LINE DRIVE METHOD AND DISPLAY DEVICE

TECHNICAL FIELD

The present invention relates to a data signal line drive circuit including analog switches for applying analog video signals to a plurality of data signal lines respectively and causing the data signal lines to hold the analog video signals respectively, the data signal lines being connected to a plurality of pixel formation portions for formation of an image to be displayed. The invention also relates to a display device including the same.

BACKGROUND ART

In a display device such as an active matrix liquid crystal display device, there are formed a plurality of data signal lines (also called "source lines"), a plurality of scanning signal lines (also called "gate lines") across the plurality of data signal lines, and a plurality of pixel formation portions disposed in a matrix pattern along the plurality of data signal lines and the plurality of scanning signal lines, on a display section such as a liquid crystal panel. Among these active matrix display devices, there are those which make use of dot sequential driving method, or SSD (Source Shared Driving) method. In the SSD method, a plurality of data signal lines in the display section are grouped into a plurality of data signal line groups each consisting of two or more predetermined number of data signal lines. The predetermined number of data signal lines in each group are supplied with analog video signals in a time-sharing fashion.

In cases where an active matrix display device makes use of the dot sequential driving method, SSD method, etc., each data signal line is supplied with an analog video signal via an ON-state analog switch; and thereafter, the analog switch's control signal level is changed to turn OFF the analog switch, whereby a voltage of the analog video signal is held in the data signal line. While the analog video signal voltage is held in each data signal line as described, one of the above-described plurality of scanning signal lines is activated (selected), whereby a voltage in the data signal line is written as a pixel data to a pixel formation portion connected to the activated scanning signal line.

(B) of FIG. 6 is a circuit diagram which shows a configuration of a portion (hereinafter called "unit sample-and-holding circuit") corresponding to one data signal line SLk (hereinafter called "focused data signal line SLk") of a sample-and-holding circuit that works in sampling analog video signals and. having each data signal line SLi (i–1 through N) hold the signal in a display device as described above (see Patent Documents 1 and 2). The unit sample-and-holding circuit includes an N channel type field effect transistor (hereinafter abbreviated as "Nch transistor") SWk serving as the analog switch; an inverter IV for making logical inversion of a control signal Sck of this analog switch; a correction capacitance element Cc which has its one end connected to the focused data signal line SL and another end connected to an output terminal of the inverter IV; and a parasitic capacitance Cgd formed between a gate terminal of the Nch transistor SWk and one of conduction terminals connected to the focused data signal line SL. The other conduction terminal of the Nch transistor SWk is supplied with an analog video signal Sv1, whereas the gate terminal of the Nch transistor SWk is supplied with the earlier-described control signal Sck. These Nch transistor SWk (including the parasitic capacitance Cgd), correction capacitance element Cc and inverter IV constitute a sampling circuit of the analog video signal Sv1. The sampling circuit and the focused data signal line's capacitance (total capacitance formed by the focused data signal line SLk and other electrodes) Csl constitute the above-mentioned unit sample-and-holding circuit.

In the sampling circuit, when the analog switch SWk is turned ON, the control signal Sck provided by a predetermined ON voltage (a HIGH level voltage (hereinafter called "H level voltage VH") in cases where the analog switch is provided by an Nch transistor) is applied to the gate terminal of the Nch transistor SWk, whereas when the analog switch is turned OFF, the control signal Sck provided by a predetermined OFF voltage (a LOW level voltage (hereinafter called "L level voltage VL") in cases where the analog switch is provided by an Nch transistor) is applied to the gate terminal of the Nch transistor SWk.

When turning OFF the Nch transistor SWk after applying an analog video signal Sv to the focused data signal line SLk via the Nch transistor SWk which works as the analog switch, the voltage of the control signal Sck starts from the ON voltage which is represented by the H level voltage VH toward the OFF voltage which is represented by the L level voltage VL; and when a potential difference between the gate terminal and the source terminal in the Nch transistor SWk reaches a threshold voltage Vth of the transistor SWk, namely, when the voltage of the control signal Sck becomes equal to a sum of a voltage Vv1 of the video signal Sv1 and the threshold voltage Vth, or a voltage Vv1+Vth (hereinafter this voltage Vv1+Vth will be called "OFF transition voltage Voff"), the transistor SWk assumes an OFF state. Thereafter, the voltage of the control signal Sck (hereinafter called "control voltage Vg") falls from the OFF transition voltage Voff to the L level voltage VL. This change in the control voltage Vg, from the OFF transition voltage Voff to the L level voltage VL, lowers a voltage of the focused data signal line SLk (hereinafter called "data signal line voltage") Vsl via the parasitic capacitance Cgd. Therefore, the sampling circuit in (B) of FIG. 6 is configured to cause the inverter IV to generate an inverted signal Sr by making a logical inversion of the control signal Sck and to apply this inverted signal Sr to the focused data signal line SLk via the correction capacitance element Cc. This reduces the drop in the data signal line voltage Vsl caused by the parasitic capacitance Cgd.

PRIOR ART DOCUMENTS

Patent Documents

Patent Document 1: Japanese Unexamined Patent Application Publication Ho. 2011-17816

Patent Document 2: Japanese Unexamined Patent Application Publication No. 2005-55461

Patent Document 3: Japanese Unexamined Patent Application Publication No. 2004-350261

Patent Document 4: Japanese Unexamined Patent Application Publication No. 2003-195834

SUMMARY OF THE INVENTION

Problems to be Solved by the Invention

However, according to the conventional technique of utilizing the sampling circuit shown in (B) of FIG. 6, as shown in (A) of FIG. 7, there is a possibility that the inverted signal Sr starts to change from the H level voltage VH toward the L level voltage VL before a time point t1 at which the analog switch SWk assumes the OFF state. This means that there will be cases where the above-described drop in the data signal line voltage Vsl caused by the parasitic capacitance Cgd is not sufficiently alleviated. In other words, as shown in (A) of FIG. 7, when the Nob transistor SWk is turned OFF, there is only a small voltage change amount ΔVc which makes contribution to correcting the drop of the data signal line voltage Vsl caused by the parasitic capacitance Cgd, in the voltage change in the inverted signal Sr. Therefore, it is impossible to sufficiently correct the drop of the data signal line voltage Vsl. One possible solution for providing a sufficient correction to the drop would be to increase the capacitance value of the correction capacitance element Cc; however, increasing the capacitance value requires a large layout area.

Also, as understood from (A) of FIG. 7, the voltage change amount ΔVc which contributes to the correction of the drop of the data signal line voltage Vsl is influenced by the timing of change in the inverted signal Sr, namely, influenced by an amount of signal delay. Therefore, it is impossible to reliably and sufficiently correct the drop of the data signal line voltage Vsl.

Further, as shown in (B) of FIG. 7, there can be cases where the inverted signal Sr completes its change from the L level voltage VL to the H level voltage VH after the control signal Sck starts to change from the H level voltage VH toward the L level voltage VL but before the time point t1 at which the Nch transistor SWk assumes OFF state: In this case, the voltage change in this inverted signal Sr makes no contribution (ΔVc=0) to the correction of the drop of the data signal line voltage Vsl caused by the parasitic capacitance Cgd. Therefore, in this case, the drop of the data signal line voltage Vsl is not corrected even if the capacitance value of the correction capacitance element Cc is increased.

It is therefore an object of the present invention to provide a data signal line drive circuit capable of reliably and sufficiently correcting the variation in the data signal line voltage when sampling the analog video signal, and to provide a display device including the same.

Solutions to the Problem

A first aspect of the present invention provides a data signal line drive circuit provided with analog switches for applying analog video signals to a plurality of data signal lines respectively and causing the plurality of data signal lines to hold the analog video signals respectively, the plurality of data signal lines being connected to a plurality of pixel formation portions for formation of an image to be displayed, the circuit including:

an analog switch provided for each of the plurality of data signal lines and including a field effect transistor having: a first conduction terminal for receiving an analog video signal to be applied to one of the pixel formation portions connected to a corresponding one of the data signal lines; a second conduction terminal connected to the corresponding data signal line; and a control terminal for receiving a control signal for switching between an ON state and an OFF state;

a correction capacitance element including a first terminal connected to the corresponding data signal line; and an inversion delaying circuit configured to generate an inversion delayed signal and apply the inversion delayed signal to a second terminal of the correction capacitance element, the inversion delayed signal being generated by logically inverting the control signal while delaying the control signal for a predetermined time in accordance with a length of time from a time point at which the control signal starts its change from a first-level voltage for bringing the transistor into an ON state to a second-level voltage for bringing the transistor into an OFF state to a time point at which the transistor assumes the OFF state.

A second aspect of the present invention provides the data signal line drive circuit according to the first aspect of the present invention, wherein the inversion delaying circuit generates the inversion delayed signal so that the inversion delayed signal starts its change from the second-level voltage to the first-level voltage after the transistor assumes the OFF state, when the transistor is turned OFF.

A third aspect of the present invention provides the data signal line drive circuit according to the second aspect of the present invention, wherein the inversion delaying circuit generates the inversion delayed signal so that the inversion delayed signal starts its change from the second-level voltage to the first-level voltage after the control signal reached the second-level voltage, when the transistor is turned OFF.

A fourth aspect of the present invention provides the data signal line drive circuit according to the first aspect of the present invention, wherein the capacitance value of the correction capacitance element is a predetermined value based on: a parasitic capacitance between the control terminal and the second conduction terminal of the transistor; a difference between the first-level voltage and the second-level voltage; and a voltage of the control signal at which the transistor assumes the OFF state when the control signal changes from the first-level voltage toward the second-level voltage.

A fifth aspect of the present invention provides the data signal line drive circuit according to the first aspect of the present invention, wherein the inversion delaying circuit includes three or a greater odd number of mutually cascade-connected inverters.

A sixth aspect of the present invention provides the data signal line drive circuit according to the first or the fifth aspect of the present invention, wherein the inversion delaying circuit includes an inversion delayer having at least one Schmitt trigger inverter and configured to generate the inversion delayed signal from the control signal.

A seventh aspect of the present invention provides the data signal line drive circuit according to the sixth aspect of the present invention, wherein the Schmitt trigger inverter in the inversion delaying circuit includes a transistor having a multi-gate structure.

A eighth aspect of the present invention provides the data signal line drive circuit according to the first aspect of the present invention, wherein the inversion delaying circuit is provided for each data signal line.

A ninth aspect of the present invention provides the data signal line drive circuit according to the first aspect of the present invention, wherein the analog switch is disposed on one end of the corresponding data signal line, and the correction capacitance element is disposed on another end of the corresponding data signal line.

A tenth aspect of the present invention provides the data signal line drive circuit according to the first or the ninth aspect of the present invention, wherein the plurality of data signal lines are grouped into a plurality of data signal line groups, each group including two or a greater predetermined number of data signal lines, the inversion delaying circuit includes a predetermined number of inversion delayers respectively corresponding to the predetermined number of data signal lines, and each of the predetermined number of inversion delayers receives a control signal which is to be applied to one of the analog switches connected to a corresponding one of the predetermined number of data signal lines which constitute each data signal line group; generates an inversion delayed signal from the control signal; and applies the inversion delayed signal to the second terminal of the correction capacitance element connected to the corresponding data signal line.

A eleventh aspect of the present invention provides the data signal line drive circuit according to the tenth aspect of the present invention, wherein the predetermined number of inversion delayers are disposed in such a manner as to be distributed on one and another ends in a direction perpendicular to a direction in which the plurality of data signal lines extend in the data signal line drive circuit.

A twelfth aspect of the present invention provides the data signal line drive circuit according to the first aspect of the present invention, wherein the correction capacitance element is constituted, by: a predetermined portion of an insulation layer which is formed to make a gate insulation film of the transistor; a predetermined portion of a conductive layer which is formed to make a gate electrode of the transistor; and a predetermined portion of a semiconductor layer which is formed to make a channel region of the transistor.

A thirteenth aspect of the present invention provides a display device having a display section provided with a plurality of data signal lines; a plurality of scanning signal lines across the plurality of data signal lines; and a plurality of pixel formation portions disposed in a matrix pattern along the plurality of data signal lines and the plurality of scanning signal lines; the display device including:

the data signal line drive circuit according to the first aspect of the present invention; and a scanning signal lines drive circuit configured to selectively drive the plurality of scanning signal lines.

A fourteenth aspect of the present invention provides the display device according to the thirteenth aspect of the present invention, wherein the display section is non-rectangular, and at least two data signal lines of the plurality of data signal lines differ from each other in length, in accordance with the shape of the display section.

A fifteenth aspect of the present invention provides a data signal line drive method by means of a data signal line drive circuit provided with analog switches for applying analog video signals to a plurality of data signal lines respectively and causing the plurality of data signal lines to hold the analog video signals respectively, the plurality of data signal lines being connected to a plurality of pixel formation portions for formation of an image to be displayed, the method including;

a step of applying an analog video signal via an analog switch to one data signal line of the plurality of data signal lines;

a step of turning the analog switch into an OFF state by changing a level of a control signal supplied to the analog switch after supplying said one data signal line with the analog video signal via the analog switch;

a step of generating an inversion delayed signal by logically inverting the control signal while delaying the control signal for a predetermined time in accordance with a length of time from a time point at which the control signal starts its change from a first-level voltage for bringing the analog switch into an ON state to a second-level voltage for bringing the analog switch into an OFF state to a time point at which the transistor assumes the OFF state; and a step of supplying the inversion delayed signal to the said one data signal line via a correction capacitance element.

Other aspects of the present invention will become clear from the first through the fifteenth aspects of the present invention and description of embodiments to be given later, so will not be stated here.

Advantages of the Invention

According to the first aspect of the present invention, when the analog switch, which is provided for each data signal line, is turned OFF, a control signal therefor is utilized to generate an inversion delayed signal and the generated signal is applied to the data signal line via the correction capacitance element. Since the field effect transistor which is included in the analog switch has a parasitic capacitance, the control signal's voltage change when turning OFF the analog switch influences the data signal line voltage via the parasitic capacitance, causing the data signal line voltage to vary from the proper value (i.e., the data signal line voltage falls or rises from the original value). However, each data signal line is supplied with the inversion delayed signal via the correction capacitance element, and this corrects the variation of the data signal voltage. The inversion delayed signal is delayed with respect to the control signal by a predetermined time in accordance with a length of time from a time point at which the control signal starts its change from the first-level voltage to the second-level voltage to a time point at which the transistor assumes an OFF state. Because of this arrangement, a large portion of a voltage change in the inversion delayed signal makes contribution to the correction of the data signal line voltage variation. As a result, there is no need for increasing the capacitance value of the correction capacitance element. Also, small fluctuations in the amount of delay in the inversion delayed signal do not affect the correction. Therefore, it is possible to reliably and sufficiently correct the parasitic capacitance rooted data signal line voltage variation resulting from the sampling of the analog video signal by the analog switch, while reducing increase in layout area.

According to the second aspect of the present invention, for each data signal line, when the transistor in the analog switch is turned OFF, the inversion delayed signal starts its change from the second level voltage to the first level voltage after the transistor has assumed the OFF state. This ensures that the entire voltage change in the inversion delayed signal makes contribution to the correction of the data signal line voltage variation, and further, that the correction is not influenced by any change in the amount of delay of the inversion delayed signal. Therefore, it is possible to more reliably and sufficiently correct the parasitic capacitance rooted data signal line voltage variation resulting from the sampling of the analog video signal by the analog switch, while reducing increase in layout area.

According to the third aspect of the present invention, for each data signal line, when the transistor in the analog switch is turned OFF, the inversion delayed signal starts its change from the second level voltage to the first level voltage after the control signal has reached the second level voltage for bringing the transistor into the OFF state. This further ensures that the entire voltage change in the inversion delayed signal makes contribution to the correction of the data signal line voltage variation, and further, that the correction is not influenced by any change in the amount of delay of the inversion delayed signal. Therefore, if is possible to more reliably and sufficiently correct the parasitic capacitance rooted data signal line voltage variation resulting from the sampling of the analog video signal by the analog switch, while reducing increase in layout area.

According to the fourth aspect of the present invention, the capacitance value of the correction capacitance element is predetermined based on: a parasitic capacitance between the control terminal and the second conduction terminal of the transistor in the analog switch provided for each data signal line; a difference between the first-level voltage and the second-level voltage; and a voltage of the transistor's control signal at which the transistor assumes the OFF state when the control signal changes from the first-level voltage toward the second-level voltage. This makes it possible to appropriately correct the parasitic capacitance rooted data signal line voltage variation and thereby offset the variation which results from sampling the analog video signal by the analog switch.

According to the fifth aspect of the present invention, three or a greater number of mutually cascade-connected inverters are included in the inversion delaying circuit which generates the inversion delayed signal from the control signal of the analog switch; and this inversion delayed signal is utilized in the correction of the parasitic capacitance rooted data signal line voltage variation that results when sampling the analog video signal by the analog switch. This makes it possible to reliably and sufficiently correct the data signal line voltage variation while reducing increase in layout area.

According to the sixth aspect of the present invention, the inversion delayer, which generates the inversion delayed signal from the analog switch control signal, includes at least one Schmitt trigger inverter; therefore, it becomes possible to increase a delay time in the inversion delayer as compared to a case where the inversion delayer is constituted by ordinary inverters only. This makes it possible to generate an inversion delayed signal which is more suitable to correct the parasitic capacitance rooted data signal line voltage variation.

According to the seventh aspect of the present invention, the Schmitt trigger inverter in the inversion delaying circuit includes a multi-gated transistor; therefore, it is possible to generate an inversion delayed signal which is more suitable to correct the parasitic capacitance rooted data signal line voltage variation while reducing power consumption.

According to the eighth aspect of the present invention, the inversion delaying circuit is provided for each data signal line, and the inversion delaying circuit is disposed uniformly in the display region; therefore the arrangement provides a high level of freedom in circuitry disposition. Also, the arrangement allows to vary composition of each inversion delayed signal, making it possible to vary the amount of voltage variation correction for each data signal line.

According to the ninth aspect of the present invention, each analog switch is disposed at one end of its corresponding data signal line, while the correction capacitance element is disposed at the other end of the corresponding data signal line; this frees, in areas on the analog switch side along the outer edge of the display region, an area which is otherwise occupied by the correction capacitance elements and an area which is otherwise occupied by wiring for the transmission of inversion delayed signal; consequently, it becomes possible to make layout with a high level of freedom without making complicated wiring.

According to the tenth aspect of the present invention, display devices utilizing SSD method are provided with the same advantages as offered by the first or the ninth aspect of the present invention.

According to the eleventh aspect of the present invention, in display devices utilizing SSD method, two or a greater predetermined number of inversion delayers which constitute the inversion delaying circuit are disposed in such a manner as to be distributed on one and the other ends in a direction perpendicular to a direction in which the data signal lines extend in the data signal line drive circuit; therefore, it is possible to ensure that areas necessary for circuitry disposition in the outer edge area of the display region are not concentrated on one end.

According to the twelfth aspect of the present invention, the correction capacitance element is constituted by a predetermined portion of an insulation layer which is formed to make a gate insulation film of the transistor; a predetermined portion of a conductive layer which is formed to make a gate electrode of the transistor; and a predetermined portion of a semiconductor layer which is formed to make a channel section of the transistor. This means that the gate insulation film's thickness variation resulting from manufacturing processes, which varies the capacitance value of the parasitic capacitance in the transistor, also varies the capacitance value of the correction capacitance, accordingly. As a result, even if the parasitic capacitance has a varied capacitance value that varies the amount of parasitic capacitance rooted data signal line voltage variation, that voltage variation is appropriately corrected.

Advantages provided by other aspects of the present invention will become clear from the first through the twelfth aspects of the present invention and description of the embodiments to be given below, so will not be stated here.

DESCRIPTION OF EMBODIMENTS

Hereinafter, embodiments of the present invention will be described with reference to the attached drawings. In each transistor referred to in the following description, the gate terminal represents the control terminal, whereas one of the drain terminal and the source terminal represents a first conduction terminal while the other represents a second conduction terminal.

<1. First Embodiment>

<1.1 Overall Configuration and Operation>

Figure 1:
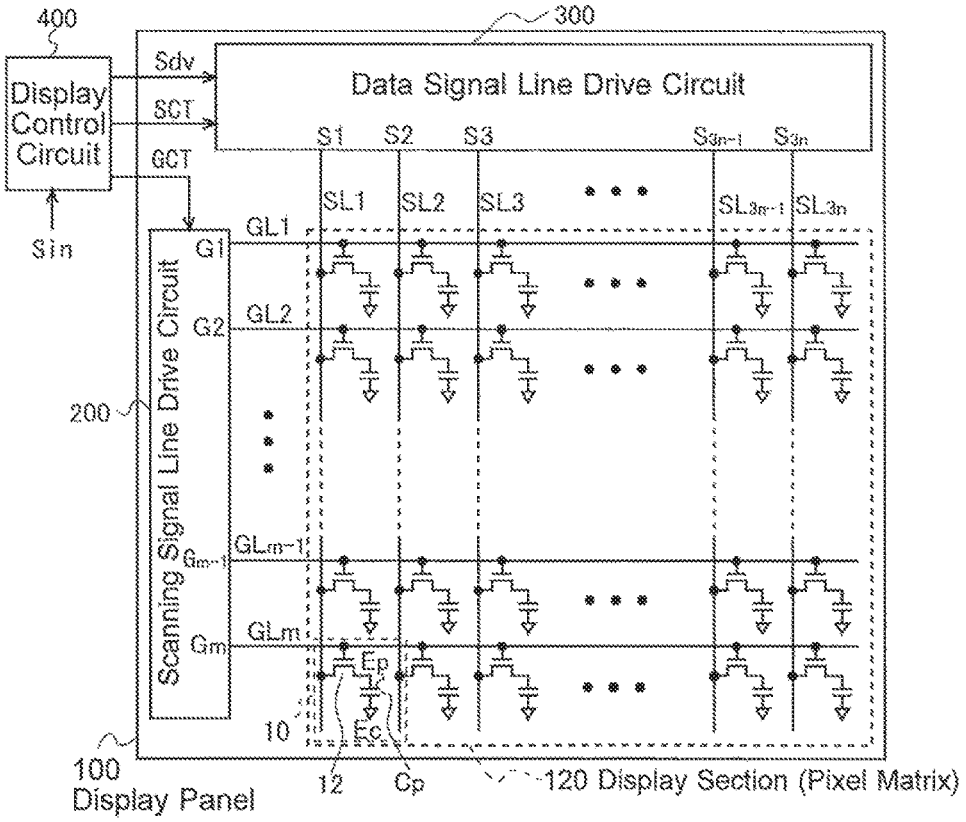
FIG. 1 is a block diagram showing a configuration of a liquid crystal display device according to a first embodiment of the present invention.

FIG. 1 is a block diagram showing an overall configuration of a liquid crystal display device according to a first embodiment of the present invention. The liquid crystal display device includes: a display panel 100 which has an active matrix display section 120; a scanning signal line drive circuit (also called "gate driver") 200; a data signal line drive circuit (also called "source driver") 300; and a display control circuit 400. The display control circuit 400 is externally supplied with an input signal Sin. The input signal Sin contains an image signal which represents an image to be displayed, and timing control signals for displaying the image.

In the display section 120, there is disposed a plurality (3*n*) of data signal lines (also called "source lines") SL1 through SL3*n;* a plurality (m) of scanning signal lines (also called "gate lines") GL1 through GLm; and a plurality (m×3n) of pixel formation portions 10 arranged in a matrix pattern along these data signal lines SL1 through SL3*n* and scanning signal lines GL1 through GLn (hereinafter, such a plurality of pixel formation portions arranged in a matrix pattern will also be called "pixel matrix"). Each pixel formation portion 10 corresponds to one of the data signal lines SL1 through SL3*n,* and also to one of the scanning signal lines GL1 through GLm. Hereinafter, if these 3*n* data signal lines SL1 through SL3*n* are not differentiated from each other, they will simply be called "data signal lines SL", and if these m scanning signal lines GL1 through GLm are not differentiated from each other, they will simply be called "scanning signal lines GL". Each pixel formation portion 10 is constituted by: a thin film transistor (hereinafter abbreviated as "TFT") 2 which serves as a switching element having its gate terminal serving as a control terminal, connected to a corresponding one of the scanning signal lines GL while having its source terminal connected to the corresponding one of the data signal lines SL; a pixel electrode Ep connected to a drain terminal of the TFT 12; a common electrode Ec provided commonly to the m×3n pixel formation portions 10; and a liquid crystal layer sandwiched between the pixel electrode Ep and the common electrode Ec and is provided commonly to these m×3n pixel formation portions 10. In the above, the pixel electrode Ep and the common electrode Ec form a liquid crystal capacitance, which functions as a pixel capacitance Cp. Typically, there is provided an auxiliary capacitance in parallel to the liquid crystal capacitance for reliable voltage holding by the pixel capacitance Cp; however, the auxiliary capacitance will not be shown nor described further since it is not directly related to the present invention. There is no specific limitation to the kind of TFT 12 included in each pixel formation portion 10; i.e., the TFT 12 may have its channel layer provided by whichever one of amorphous silicon, polysilicon, microcrystalline silicon, continuous grain silicon (CG silicon), oxide semiconductor, etc. Likewise, a type of the liquid crystal panel (the display panel 100) which includes the display section 120 is not limited to, e.g., VA (Vertical Alignment) type, (Twisted Hematic) type or the like where an electric field application direction is vertical to the liquid crystal layer: In other words, a type in which electric field application direction may be generally parallel to the liquid crystal layer, such as IPS (In-Plane Switching) type, may be employed.

The display control circuit 400 receives the input signal Sin externally, and based on this input signal Sin, generates and outputs a digital image signal Sdv, a data-side control signal SCT, a scanning-side control signal GCT, and a common voltage Vcom (not shown). The digital image signal Sdv and the data-side control signal SCT are supplied to the data signal line drive circuit 300, the scanning-side control signal GCT is supplied to the scanning signal line drive circuit 200, and the common voltage Vcom is supplied to the common electrode Ec in the display section 120.

The data signal line drive circuit 300 generates data signals S1 through S3*n* based on the digital image signal Sdv and the data-side control signal SCT, and applies them to data signal lines SL1 through SL3*n* respectively. Details of the data signal line drive circuit 300 will be described later.

The scanning signal line drive circuit 200 generates scanning signals G1 through Gm based on the scanning-side control signal GCT and applies them to the scanning signal lines GL1 through GLm, thereby repeating the application of active scanning signals to the scanning signal lines GL1 through GLm at a predetermined cycle. The scanning-side control signal GCT contains, for example, a gate clock signal and a gate start pulse signal. The scanning signal line drive circuit 200 operates its unillustrated shift register, etc. in accordance with the gate clock signal and the gate start pulse signal, and thereby generates scanning signals G1 through Gm.

The display panel 100 is provided with an unillustrated backlight unit on its back side, to provide lighting onto the back surface of the display panel 100. The backlight unit is driven by the display control circuit 400, but may be driven differently. If the display panel 100 is of a reflection type, then it is not necessary to have the backlight unit.

As described above, data signals are applied to the data signal lines SL, scanning signals are applied to the scanning signal lines GL and the backlight is applied onto the back surface of the display panel 100, whereby an image represented by the externally supplied input signal Sin is displayed in the display section 120 which constitutes the display area of the display panel 100.

It should be noted here that in the arrangement shown in FIG. 1, one or both of the data signal line drive circuit 300 and the scanning signal line drive circuit 200 may be provided in the display control circuit 400. Also, one or both of the data signal line drive circuit 300 and the scanning signal line drive circuit 200 may be formed integrally with the display section 120. In this case, the data signal line drive circuit 300 may be integrated only partially (e.g., only a demultiplexing circuit 320 and a correction circuit 330 which will be described later and shown in FIG. 2) with the display section 120.

<1.2 Configuration and Operation of Data Signal Line Drive Circuit>

Figure 2:
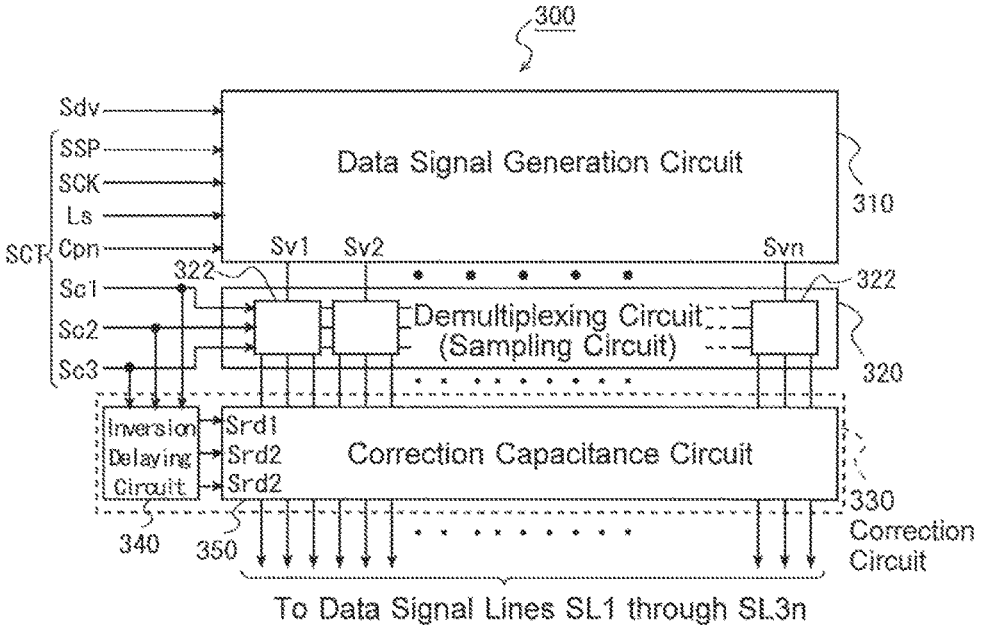
FIG. 2 is a block diagram showing a configuration of a data signal line drive circuit according to the first embodiment.

FIG. 2 is a block diagram showing a configuration of the data signal line drive circuit 300 according to the present embodiment. The liquid crystal display device according to the present embodiment makes use of an SSD method in which three data signal lines SL3i−2, SL3i−1 and SL3i that are mutually adjacent in the display panel 100 are grouped into one, so as to constitute n sets of data signal line groups (i=1 through n), and the three data signal lines in each group are supplied with analog video signals in a time-sharing fashion. Accordingly to this arrangement, the data signal line drive circuit 300 has, in addition to a data signal generation circuit 310 which generates n video signals Sv1 through Svn as data signals for driving the display panel 100, a demultiplexing circuit 320 which conforms to the SSD method, and a correction circuit 330 for compensation for a signal level drop which takes place when sampling the video signals Sv1 through Svn in the demultiplexing circuit 320. The correction circuit 330 includes a correction capacitance circuit 350 and an inversion delaying circuit 340.

The digital image signal Sdv from the display control circuit 400 is supplied to the data signal generation circuit 310. Out of the data-side control signal SCT from the display control circuit 400, a source start pulse signal SSP, a source clock signal SCK, a latch strobe signal Ls, and a polarity switching control signal Cpn are supplied to the data signal generation circuit 310, whereas a connection switching control signals Sc1 through Sc3 axe supplied to the demultiplexing circuit 320.

The data signal generation circuit 310 operates unillustrated shift registers, sampling latch circuits, etc. provided therein based on the source start pulse signal SSP, the source clock signal SCK, and the latch strobe signal Ls, thereby generating n digital signals based on the digital image signal Sdv, and converts these n digital signals into analog signals using an unillustrated DA conversion circuit, to generate n video signals Sv1 through Svn as analog data signals for driving the display panel 100. Since the present embodiment makes use of the SSD method as described earlier, the video signal Svi is divided into three data signals S3i−2, S3i−1, S3*i*, which are respectively applied to the data signal lines SL3i−2, SL3i−1, SL3i of the display section 120 (i=1 through n). The polarity switching control signal Cpn is a control signal for AC driving of the display section 120 to prevent deterioration of the liquid crystal, and is utilized to switch the polarity of the video signals Sv1 through Svn at a predetermined timing. However, the AC driving will not be described in detail since it is well known to those skilled, in the art and is not directly related to the present invention.

Figure 3:
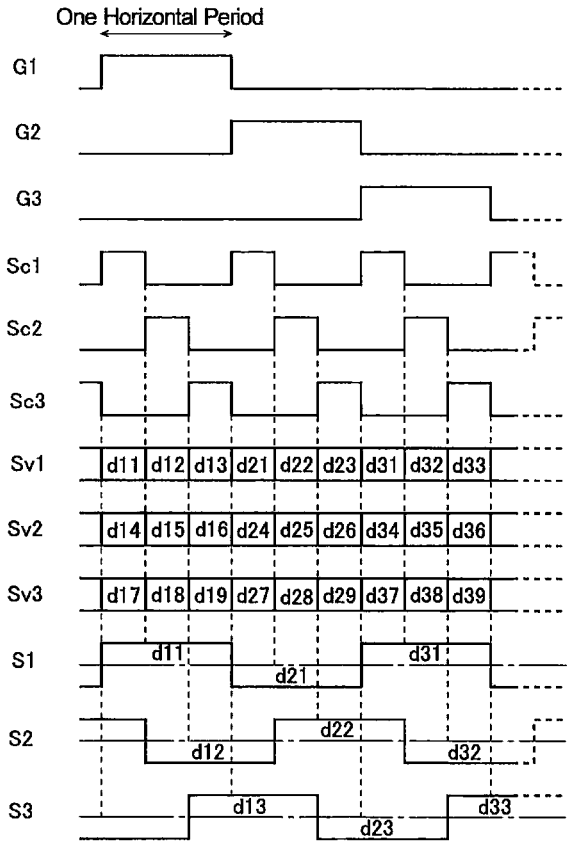
FIG. 3 is a timing chart for describing an operation of the data signal line drive circuit according to the first embodiment.

FIG. 3 is a timing chart to describe an operation of the data signal line drive circuit 300 in the present embodiment. Hereinafter, FIG. 2 and FIG. 3 will be referenced, in describing an operation of the data signal line drive circuit 300.

The demultiplexing circuit 320 includes n demultiplexers 322: The i-th demultiplexer 322 is supplied with the i-th video signal Svi (i=1 through n). Each demultiplexer 322 is supplied with connection switching control signals Sc1 through Sc3 as shown in FIG. 3. For the sake of description, each horizontal period will be divided into three, and the resulting small periods will be sequentially called the first, the second and the third periods. In these connection switching control signals Sc1 through Sc3, the first connection switching control signal Sc1 is active only in the first period, the second connection switching control signal Sc2 is active only in the second period, and the third connection switching control signal Sc3 is active only in the third period. Herein, a HIGH level (H level) will represent active, whereas a LOW level (L level) represents non-active. Each demultiplexer 322 has an input of video signal (hereinafter called "input video signal") Svi, which is then applied in the time sharing fashion to three data signal lines SL3i−2, SL3i−1, SL3i that are connected thereto through the correction capacitance circuit 350. Each demultiplexer 322 supplies its input video signal Svi to the data signal line SL3i−2 when the first connection switching control signal Sc1 is active (H level); to the data signal line SL3i−1 when the second connection switching control signal Sc2 is active (H level); and to the data signal line SL3i when the third connection switching control signal Sc3 is active (H level). As a result, the data signal line which is supplied with the input video signal Svi is switched sequentially in the order of the data signal lines SL3i−2, SL3i−1 and SL3i in each horizontal period.

Following the operation described above, the data signals S1 through S3 as shown in FIG. 3 are applied respectively to the data signal lines SL1 through S13. The same applies to the other data signal lines SL3i−2, SL3i−1, SL3i (i=2 through n). FIG. 3 includes a symbol dij associated with the video signals Sv1 through Sv3 and data signals S1 through S3. This symbol dij denotes a pixel data to be written to the pixel formation portion 10 (i.e., to the pixel capacitance Cp thereof) which is connected to the i-th scanning signal line Gli and the j-th data signal line SLj (i=1 through m, j=1 through 3*n*). Each data signal line SLj forms a capacitance with another electrode (common electrode Ec and an electrode which constitutes the scanning signal line GL) (hereinafter this capacitance will be called "data signal line capacitance Csl"). Because of this, the data signal line capacitance Csl and the demultiplexer 322 work together to make the video signal Svi to foe sampled by the connection switching control signal Sck and held in the data signal line SL3(i−1)+k (i=1 through n; k=1, 2, 3) (see data signals S1 through S3 in FIG. 3). It should be noted here that the polarity of the video signal Svi changes in accordance with the earlier-described polarity switching control signal Cpn (not illustrated), and the polarity of the data signals S3i−2, S3i−1 and S3i also change accordingly (see data signals S1 through S3 in FIG. 3).

FIG. 3 assumes that the display panel 100 is driven by a dot inversion driving method; namely, the polarity of data signal supplied to each pixel formation portion 10 is inverted for each frame period, and in addition, pixel formation portions adjacent to each other in the direction in which the data signal line SL extends are supplied with data signals of mutually inversed polarity, and further, pixel formation portions adjacent in the direction in which the scanning signal lines GL extends are also supplied with data signals of mutually inversed polarity. However, the AC driving method for the liquid crystal display device according to the present invention is not limited to the dot inversion driving method: For example, a line inversion driving method may be used so that the display panel 100 is driven in such a fashion that pixel formation portions adjacent to each other in the direction in which the data signal line SL extends are supplied with data signals of mutually inversed polarity, while pixel formation portions adjacent to each other in the direction in which the scanning signal lines GL extends are supplied with data signals of the same polarity.

Figure 4:
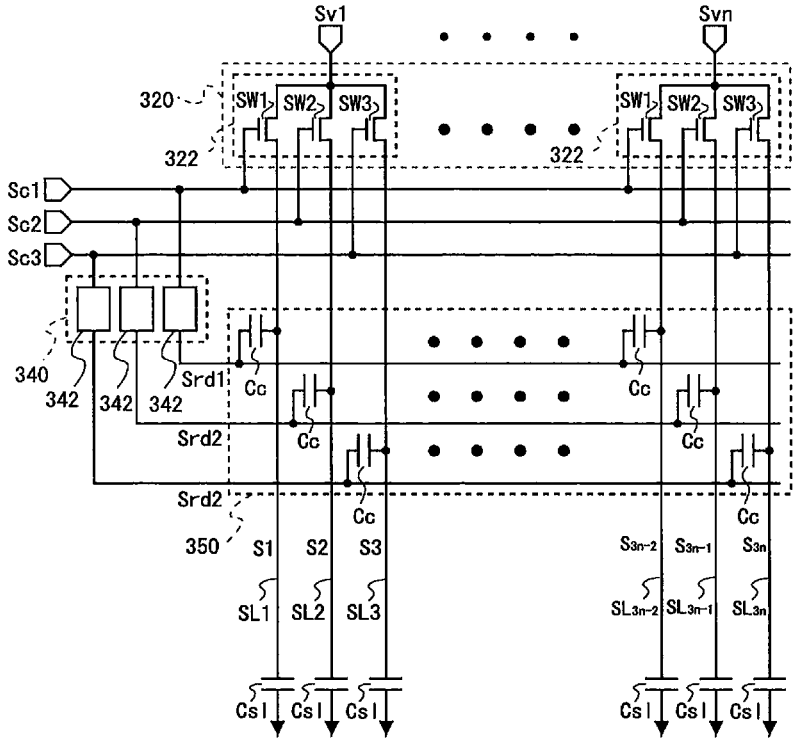
FIG. 4 is a circuit diagram showing a configuration for sampling a video signal and correcting its sampled value according to the first embodiment in the data signal line drive circuit.

FIG. 4 is a circuit diagram which shows an arrangement for sampling the video signal Svi and correcting its sampled value in the data signal line drive circuit 300 according to the present embodiment; in other words, it is a circuit diagram which shows detailed construction of the demultiplexing circuit 320 and the correction circuit 330 (correction capacitance circuit 350 and inversion delaying circuit 340). In the present embodiment, at least the demultiplexing circuit 320, the correction capacitance circuit 350, and the inversion delaying circuit 340 of the data signal line drive circuit 300 are integrally formed with the display section (pixel matrix) 120; however, the present invention is not limited to this.

As shown in FIG. 4, in the present embodiment, each demultiplexer 322 in the demultiplexing circuit 320 includes three thin film transistors SW1 through SW3 each provided by an Nch transistor serving as an analog switch. In each demultiplexer, the Nch transistors SW1 through SW3 have their first conduction terminals connected to each other and are supplied with the video signal Svi; the Nch transistors SW1 through SW3 have their second conduction terminals connected to the data signal lines SL3i−2, SL3i−1, SL3i respectively (i=1 through n). Also, in each demultiplexer 322, the Nch transistors SW1 through SW3 have their control terminals, i.e., gate terminals, supplied with the first through the third connection switching control signals Sc1 through Sc3 respectively. It should be noted here that which of the first and the second conduction terminals in the Nch transistors SW1 through SW3 serves as the drain terminal (or as the source terminal) depends on the direction of the current flowing through the Nch transistors SW1 through SW3: For the sake of convenience, description hereafter will assume that the first conduction terminal serves as the source terminal and the second conduction terminal serves as the drain terminal.

The inversion delaying circuit 340 includes a first, a second, and a third inversion delayers 342. These first through third inversion delayers 342 are supplied, with the first through the third connection switching control signal Sc1 through Sc3 respectively. The first through the third inversion delayers 342 make logical inversion of the first through the third connection switching control signals Sc1 through Sc3 respectively, delay the respective signals by a predetermined time, thereby generating the first through the third inversion delayed signals Srd1 through Srd3 respectively. The first through the third inversion delayed signals Srd1 through Srd3 are supplied to the correction capacitance circuit 350.

The correction capacitance circuit 350 includes one correction capacitance element Cc for each data signal line SL. Each correction capacitance element Cc has one of its terminals connected to its corresponding data signal line SL, To the other terminal of the correction capacitance element Cc connected to the data signal line SL3(i−1)+k that is connected to the second conduction terminal (drain terminal) of its corresponding Nch transistor SWk in each demultiplexer 322, the k-th inversion delayed signal Srdk is supplied (k=1, 2, 3).

Figure 5:
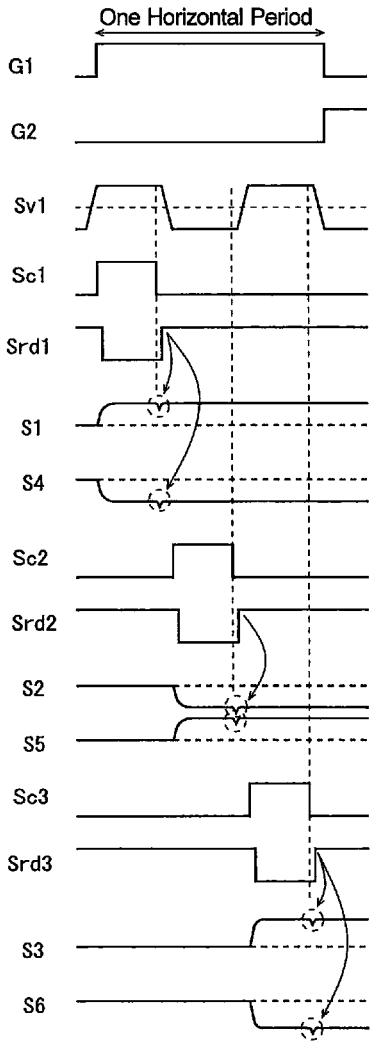
FIG. 5 is a signal waveform chart showing a sample-and-holding operation of a video signal in the data signal line drive circuit according to the first embodiment.

Each Nch transistor SWk in each demultiplexer 322 in the demultiplexing circuit 320 serving as the sampling circuit has a parasitic capacitance Cgd which is formed between its gate terminal and the second conduction terminal (drain terminal). Because of this, when the Nch transistor SWk in the i-th demultiplexer 322 changes its state from ON state to OFF state, a voltage change in the connection switching control signal Sck influences the voltage of the data signal line SL3(i−1)+k via the parasitic capacitance Cgd (i=1 through n; k=1, 2, 3). As a result, the voltage of the data signal line SL3(i−1)+k immediately after the Nch transistor SWk is turned OFF, i.e., the voltage (data signal line voltage Vsl) of the data signal S3(i−1)+k drops to a lower voltage than that of the video signal Svi supplied to the data signal S3(i−1)+k when the Nch transistor SWk is in its ON state. In other words, the data signal line voltage Vsl which is obtained by sampling the video signal Svi with the connection switching control signal Sck becomes lower than the original voltage because of the parasitic capacitance Cgd. However, in the capacitance correction circuit 350, each data signal line SL3(i−1)+k is supplied with an inversion delayed signal Srk via the correction capacitance element Cc, which corrects the drop of the data signal line voltage Vsl (see signal waveforms S1, S4, S2, S5, S3, S6 in FIG. 5).

Hereinafter, detailed description will be made for an operation to correct the above-mentioned drop of the data signal line voltage Vsl at the time of sampling the video signal Svi. As an example, a sampling of the first video signal Sv1 will be used with reference to FIG. 6 and FIG. 7.

Figure 6:
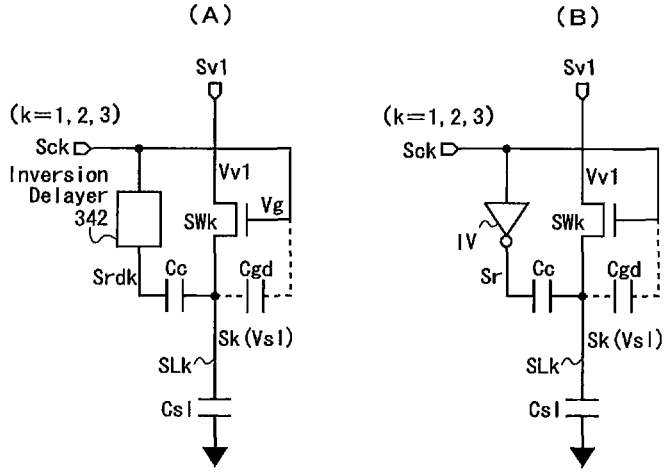
FIG. 6 consists of a circuit diagram (A) showing a configuration of a unit sample-and-holding circuit according to the first embodiment and a circuit diagram (B) showing a configuration of a conventional unit sample-and-holding circuit.
Figure 7:
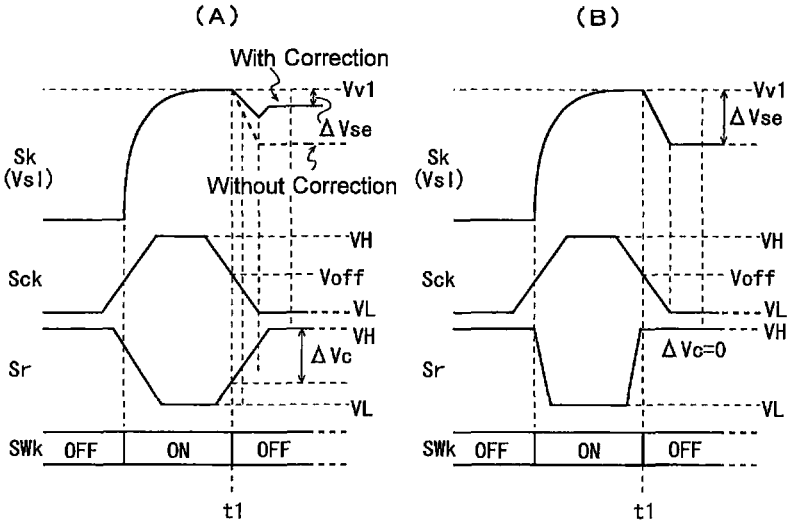
FIG. 7 consists of signal waveform charts (A) and (B) showing operations of a conventional unit sample-and-holding circuit.
Figure 8:
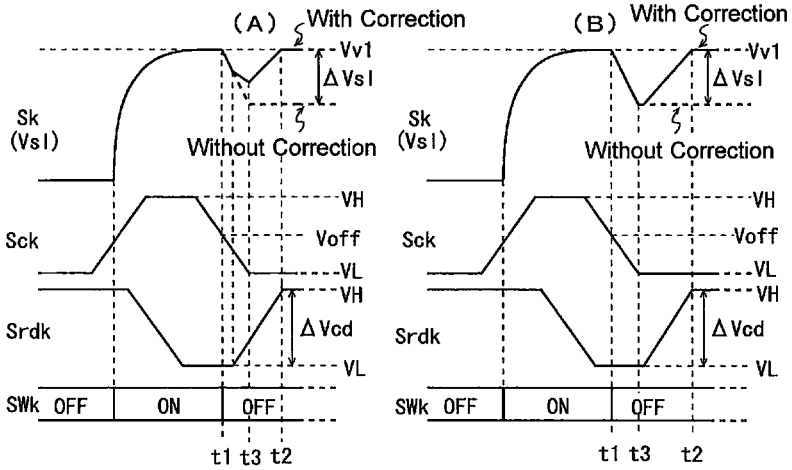
FIG. 8 consists of signal waveform charts (A) and (B) showing operations of the conventional unit sample-and-holding circuit according to the first embodiment.

(A) of FIG. 6 is a circuit diagram showing a configuration of a partial circuit for sampling a video signal Sv1 and holding its sampled value in one data signal line (focused data signal line) SLk in the present embodiment; in other words, the FIG. shows a configuration of a unit sample-and-holding circuit. (B) of FIG. 6 shows a corresponding configuration in a conventional display device which makes use of an SSD method, for example; in other words, the drawing shows a circuit diagram of a conventional unit sample-and-holding circuit (hereinafter called "conventional unit sample-and-holding circuit") corresponding to the unit sample-and-holding circuit shown in (A) of FIG. 6. FIG. 7 is a signal waveform chart which shows an operation of the conventional unit sample-and-holding circuit shown in (B) of FIG. 6, whereas FIG. 8 is a signal waveform chart which shows an operation of the unit sample-and-holding circuit according to the present embodiment shown in (A) of FIG. 6.

In whichever of the unit sample-and-holding circuits in (A) of FIG. 6 and (B) of FIG. 6, the Nch transistor SWk which serves as an analog switch changes its state from ON state to OFF state at a time point when the connection switching control signal Sck which serves as a sampling pulse signal has reached a predetermined voltage Voff in the process of changing from an H level voltage VH that represents an ON voltage to an L level voltage VL that represents an OFF voltage.

In the conventional unit sample-and-holding circuit shown in (B) of FIG. 6, an inverted signal Sr obtained from an inverter IV is applied to the focused data signal line SLk via the correction capacitance element Cc. As shown in (A) of FIG. 7, this inverted signal Sr starts its change from the L level voltage VL to the H level voltage VH before the time point t1 which is a time point when the Nch transistor SWk changes its state from ON state to OFF state. Because of this, a voltage change amount of the inverted signal Sr during the time when the focused data signal line SLk is in its floating state, namely, a voltage change amount ΔVc which contributes to correcting the drop of the data signal line voltage Vsl caused by the parasitic capacitance Cgd is smaller than VH−VL which is the voltage change amount of the inverted signal Sr at the time when the Nch transistor SWk turns OFF. As a result, it is not possible to sufficiently correct the drop of the data signal line voltage Vsl caused by the parasitic capacitance Cgd (hereinafter called "parasitic capacitance rooted data signal line voltage drop"); consequently, an actual voltage held by the focused data signal line SLk has an error ΔVse with respect to a proper voltage Vv1 which is supposed to be the result of sampling the video signal Sv1 and to be held in the focused data signal line SLk.

Especially, as shown in (B) of FIG. 7, there can be cases where, the inverted signal Sr completes its change from the L level voltage VL to the H level voltage VH after the connection switching control signal Sck starts to change from the K level voltage VH toward the L level voltage VL but before the time point t1 at which it has reached the OFF transition voltage Voff (the time point t1 at which the Nch transistor SWk assumes OFF state): In this case, the voltage change in this inverted signal Sr makes no contribution to the correction of the drop of the data signal line voltage Vs1 (ΔVc=0) caused by parasitic capacitance Cgd. Therefore, in this case, the parasitic capacitance roofed data signal line voltage drop is not corrected even if the capacitance value of the correction capacitance element Cc is increased.

Contrary to this, in the unit sample-and-holding circuit according to the present invention shown in (A) of FIG. 6, an inversion delayed signal Srdk obtained from the inversion delayer 342 is applied to the focused data signal line SLk via the correction capacitance element Cc. As shown in (A) or FIG. 8, this inversion delayed signal Srdk starts its change from the L level voltage VL to H the level voltage VH after the time point t1 which is the time point when the Nch transistor SWk changes its state from ON state to OFF state. Because of this, the data signal line SLk is in a floating state during the time in which the inversion delayed signal Srdk changes from the L level voltage VL to the K level voltage VH. As a result, a voltage change amount ΔVcd=VH−VL of the inversion delayed signal Srdk during this time makes contribution to correcting the parasitic capacitance rooted data signal line voltage drop. This voltage change amount ΔVcd=VH−VL that makes contribution to the correction is greater than the voltage change amount ΔVc which makes contribution to the correction in the conventional unit sample-and-holding circuit. Hence, according to the present embodiment, it is possible to offset the parasitic capacitance rooted data signal line voltage drop ΔVsl with the voltage change amount ΔVcd of the inversion delayed signal Srdk without increasing the capacitance value of the correction capacitance element Cc but by making an appropriate setting as will be described later (see (A) of FIG. 8).

In the conventional unit sample-and-holding circuit, the voltage change amount ΔVc, which is the correction contributing portion of the entire voltage change of the inverted signal Sr, is dependent on the timing at which the inverted, signal Sr starts its change from the L level voltage VL to the H level voltage VH. As a result, correction of the parasitic capacitance rooted data signal line voltage drop is influenced by the amount of delay in the inverted signal Sr. Contrary to this, according to the present embodiment, the inversion delayed signal Srdk starts its change from the L level voltage VL to the H level voltage VH after the Nch transistor SWk has switched from ON state to OFF state. Therefore, as far as the inversion delayer 342 operates within this time requirement, the amount of delay in the inversion delayed signal Srdk does not influence the correction of the parasitic capacitance rooted data signal line voltage drop.

<1.3 Setting of the Capacitance Value of the Correction Capacitance Element>

If the present embodiment did not have the correction circuit 330 (inversion delaying circuit 340 and correction capacitance circuit 350), the voltage which is to be held in the data signal line SL3(i−1)+k would experience a drop from the proper voltage (from the voltage Vvi of the video signal Svi) due to the parasitic capacitance Cgd of the transistor SWk that is an analog switch serving as the sampling switch when sampling the video signal Svi by the connection switching control signal Sck (i=1 through n; k=1, 2, 3). In the present embodiment, in order to correct this parasitic capacitance rooted data signal line voltage drop, the inversion delayed signal Srdk is supplied to the data signal line SL3(i−1)+k via the correction capacitance element Cc. In order to offset the parasitic capacitance rooted data signal line voltage drop ΔVsl in this correction, it is necessary to appropriately set the capacitance value of the correction capacitance element Cc (hereinafter, this capacitance value will also be represented by the symbol "Cc"). Hereinafter, description will exemplify how an appropriate capacitance value of the correction capacitance element Cc can be determined, with reference to (A) of FIG. 6 and FIG. 8 (A) (i=1; k=1, 2, 3).

As shown in (A) of FIG. 8, the connection switching control signal Sck starts dropping from the H level voltage VH (ON voltage), and reaches the OFF transition voltage Voff (=Vv1+Vth) at the time point t1, whereupon the Nch transistor SWk switches from OP state to OFF state. Thereafter, the inversion delayed signal Srdk starts rising from the L level voltage VL and reaches the H level voltage VH at a time point t2. How, if it is assumed that the connection switching control signal Sck reaches the L level voltage VL (OFF voltage) by this time point t2, then the amount of charge Q1 in the focused data signal line SLk at the time point t1 is given by the following mathematical expression, where the data signal line voltage Vsl (voltage in the focused data signal line SLk) at the time point t1 is represented by a symbol Vsl1;

$$Q1=Csl(Vsl-Vo)+Cgd(Vsl-Voff)+Cc(Vsl-VL) \quad (1)$$

where, Vo represents the voltage at the other electrode involved in the formation of the data signal line capacitance Csl (Note that the data signal line is one of the electrodes involved in the formation of the capacitance Csl). On the other hand, if the data signal line voltage Vsl at the time point t2 is represented by a symbol Vs2, the amount of charge Q2 in the focused data signal line SLk at the time point t2 is given by:

$$Q2=Csl(Vs2-Vo)+Cgd(Vs2-VL)+Cc(Vs2-VH) \quad (2)$$

Assume here that the Nch transistor SWk serving as an analog switch changes its state from ON state to OFF state instantaneously at a time point when the connection switching control signal Sck which is falling from the H level voltage VH has reached the OFF transition voltage Voff: Then, the focused data signal line SLk will assume a floating state from the time point t1 to the time point t2, and there is no charge flowing in or out of the focused data signal line SLk. Hence, Q1=Q2, and the mathematical expressions (1) and (2) give:

$$Csl(Vs1-Vo)+Cgd(Vs1-Voff)+Cc(Vs1-VL)=Csl(Vs2-Vo)+Cgd(Vs2-VL)+Cc(Vs2-VH) \quad (3)$$

Now, if the parasitic capacitance rooted data signal line voltage drop ΔVsl is offset by the voltage change ΔVcd (=VH−VL) in the inversion delayed signal Srdk via the correction capacitance element Cc, then the expression Vs2=Vs1 is true. Substituting this into the mathematical expression (3) and arranging it gives:

$$Cc=Cgd\cdot(Voff-VL)/(VH-VL) \quad (4)$$

Therefore, it is possible to determine an appropriate capacitance value of the correction capacitance element Cc from the mathematical expression (4). By utilizing the correction capacitance element Cc which has the capacitance value determined as described above, in the correction capacitance circuit 350, it is possible to offset the parasitic capacitance rooted data signal line voltage drop ΔVsl with the inversion delayed signal Srdk. As understood from the mathematical expression (4), the determined capacitance value of the correction capacitance element Cc is smaller than the parasitic capacitance Cgd.

Note, however, that the OFF transition voltage Voff, which is given by Vv1+Vth, or more generally by Vvi+Vth (i=1 through n), is dependent on the voltage Vvi of the video signal Svi and therefore, the capacitance value of the correction capacitance element Cc which is given by the mathematical expression (4) is also dependent on the voltage Vvi of the video signal Svi. Consequently, in the present embodiment, a typical or representative fixed value Vvf is selected in advance as the voltage Vvi of the video signal Svi, and then the capacitance value of the correction capacitance element Cc is obtained by substituting an OFF transition voltage Voff (fixed value) when Vvi=Vvf in the mathematical expression (4). Specific examples of the fixed value Vvf include a time average, median and mode of the voltage Vvi in the video signal Svi. Other examples of the fixed value Vvf include a maximum value or a minimum value of the voltage Vvi in the video signal Svi.

In the example given above, it is assumed that the Nch transistor SWk serving as an analog switch is an ideal switching element which changes its state from ON state to OFF state instantaneously at the time point t1 when the connection switching control signal Sck (voltage Vg at the gate terminal) falls from the H level voltage VH and has reached the OFF transition voltage Voff. Actually, however, the Nch transistor SWk has various parameters other than the threshold Vth, and these parameters also contribute to the data signal line voltage drop ΔVsl. In order to determine an appropriate capacitance value of the correction capacitance element Cc accurately by taking these influences, one possible idea is to perform a computer simulation of the operation of the circuit shown in (A) of FIG. 6 based on an actual property of the Nob transistor SWk (property which indicates a relationship between a gate-source voltage, a drain-source voltage and a drain current of the Nch transistor SWk) to obtain time-course changes and so on of the data signal line voltage Vsl at the time of sampling the video signal Sv1, and use results of the simulation as a basis to determine the capacitance value of the correction capacitance element Cc. This makes it possible to determine a more accurate capacitance value of the correction capacitance element Cc for offsetting the parasitic capacitance rooted data signal line voltage drop ΔVsl.

It should be noted here that if the actual property of the Nch transistor SWk serving as the analog switch is taken into account, the inversion delayer 342 may be configured as shown in (B) of FIG. 8 so that the inversion delayed signal Srdk starts its change from the L level voltage VL to the H level voltage VH after the connection switching control signal Sck has reached the L level voltage VL (OFF voltage) and the Nch transistor SWk has completely entered its OFF state (after the time point t3 shown in FIG. 8). Such an arrangement makes it possible to reliably exclude the influence from the amount of delay in the inversion delayed signal Srdk on the correction of the parasitic capacitance rooted data signal line voltage drop ΔVsl.

<1.4 First Example>

Figure 9:
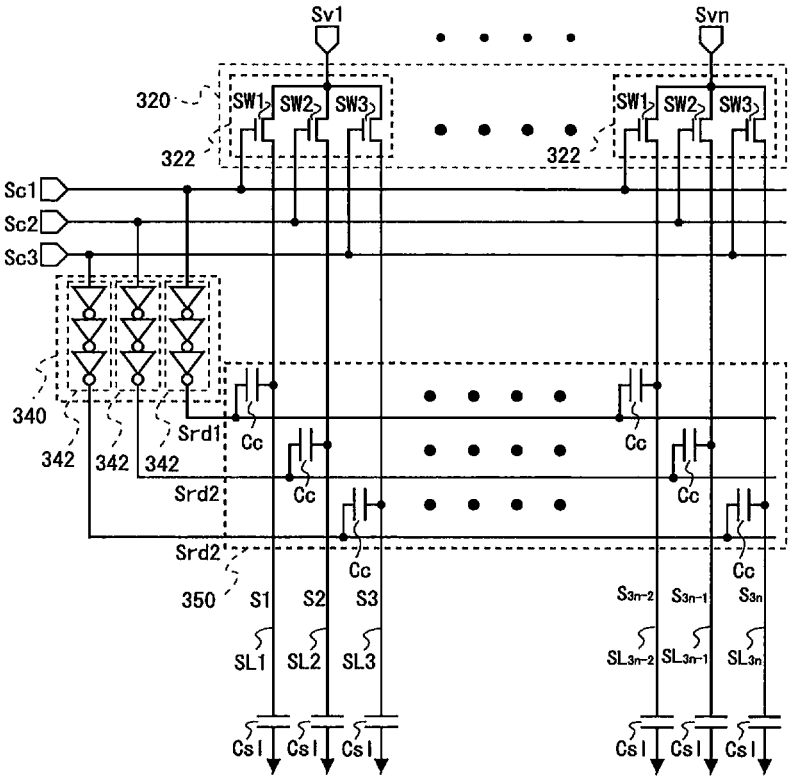
FIG. 9 is a circuit diagram showing a first example for sampling a video signal and correcting its sampled value in the data signal line drive circuit according to the first embodiment.

FIG. 9 is a circuit diagram showing a first example for sampling a video signal Svi and correcting its sampled value in the data signal line drive circuit 300 according to the present embodiment. As has been described, in the present embodiment, the inversion delaying circuit 340 is utilized to generate the inversion delayed signal Srdk as a signal to correct the parasitic capacitance rooted data signal line voltage drop which occurs when sampling the video signal Svi (k=1, 2, 3). As shown in FIG. 9, in the present example, each inversion delayer 342 in the inversion delaying circuit 340 is implemented by three cascade-connected inverters. Parts of the present example other than the inversion delaying circuit 340 have identical configurations with the earlier-described configurations shown in FIG. 2 and FIG. 4 and therefore, those identical components are indicated with the same reference symbols and description therefor will not be repeated here.

Figure 10:
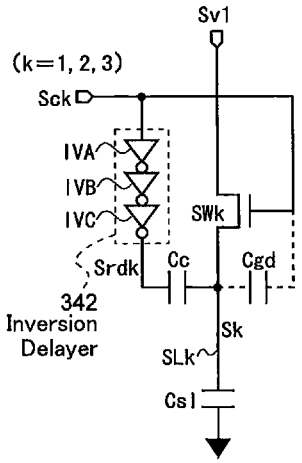
FIG. 10 is a circuit diagram showing a configuration of a unit sample-and-holding circuit in the first example of the first embodiment.
Figure 11:
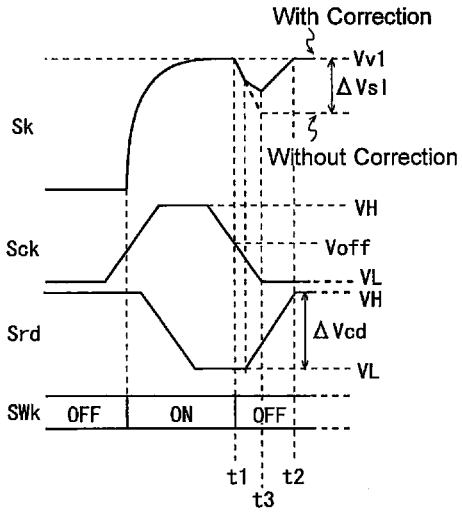
FIG. 11 is a signal waveform chart showing an operation of the unit sample-and-holding circuit in the first example of the first embodiment.

Next, an arrangement and an operation of a primary portion in the present example will be described with a focus on one data signal line SLk. FIG. 10 is a circuit diagram which shows a configuration of a unit sample-and-holding circuit that is a portion of a circuit for sampling a video signal Sv1 and holding its sampled value in one data signal line (focused data signal line) SLk in the present example. This unit sample-and-holding circuit is the unit sample-and-holding circuit shown in (A) of FIG. 6, wherein the inversion delayer 342 is provided by three, mutually cascade-connected inverters IVA, IVB, IC. This unit sample-and-holding circuit operates in the same way as the unit sample-and-holding circuit shown in (A) of FIG. 6. The operation is shown in a signal waveform chart in FIG. 11. Since the chart is identical with the signal waveform chart in (A) of FIG. 8, description will not toe repeated here.

In the present example, three inverters are mutually cascade-connected, whereby the connection switching control signal Sck is logically inverted and delayed by a necessary time. The necessary time means an amount of time necessary for appropriately correcting the parasitic capacitance rooted data signal line voltage drop with the inversion delayed signal Srdk. For example, it is an amount of time to allow the inversion delayed signal Srdk to start its change from the L level voltage VL toward the H level voltage VH after the connection switching control signal Sck started its change from the B level voltage VH to the L level voltage VL and reached the OFF state transition voltage Voff at the time point t1. Alternatively, the necessary time may be an amount of time to allow the inversion delayed signal Srdk to start its change from the L level voltage VL toward the H level voltage VH after the connection switching control signal Sck reached the L level voltage VL and the Nch transistor SWk completely assumes the OFF state at the time point t3 (see (B) of FIG. 8).

Figure 12:
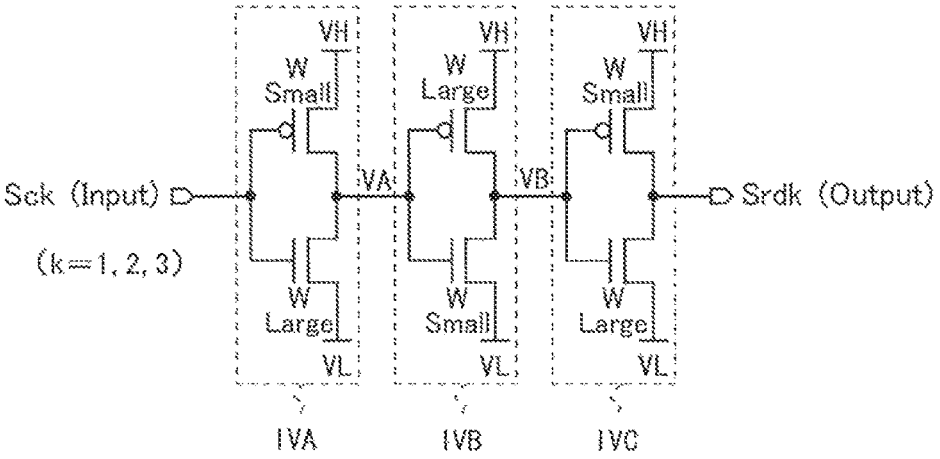
FIG. 12 is a circuit diagram showing a detailed configuration of an inversion delayer in the first example of the first embodiment.

FIG. 12 is a circuit diagram which shows a preferable, detailed configuration of each inversion delayer 342 in FIG. 10. In this detailed configuration, each of the inverters IVA, IVB, IVC is provided toy a CMOS (Complementary Metal-Oxide-Semiconductor) inverter made of a P-channel field effect field transistor (hereinafter called "Pch transistor") and an Nch transistor connected to each other as shown in FIG. 12. The Pch transistor of the first-stage inverter IVA, the Nch transistor of the second-stage inverter IVB, and the Pch transistor of the third-stage inverter IVC have their channel width W made smaller than normal, whereas the Nch transistor of the first-stage inverter IVA, the Pch transistor of the second-stage inverter IVB, and the Nch transistor of the third-stage inverter IVC have their channel width W made larger than normal.

Figure 13:
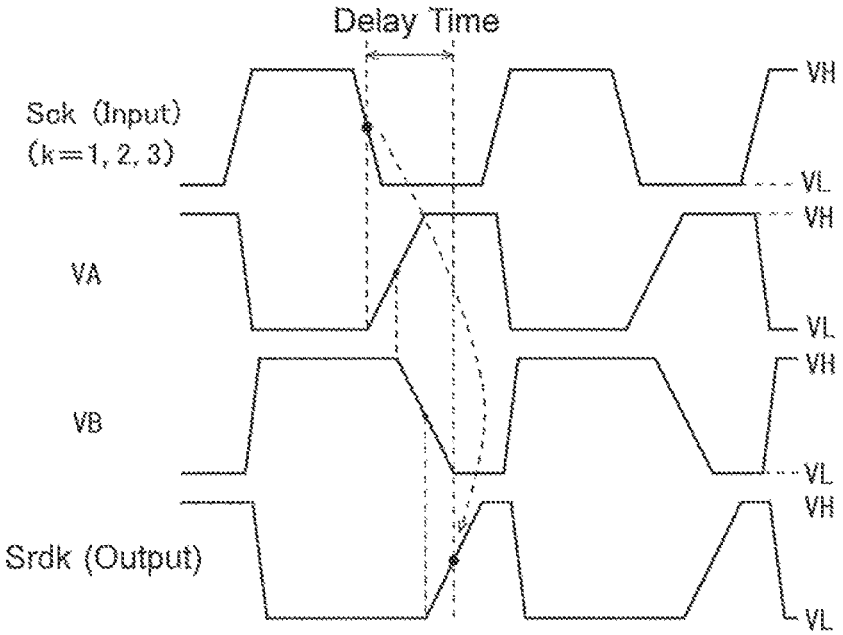
FIG. 13 is a signal waveform chart for describing an operation of the inversion delayer shown in FIG. 12.

The arrangement as described provides, as shown in FIG. 13, a longer rise time for the first-stage inverter IVA's output signal VA, a longer fall time for the second-stage inverter IVB's output signal VB, and a longer rise time for the third-stage inverter IVC's output signal which is the inversion delayed signal Srdk, than normal. Therefore, it is possible to make the delay time in the inversion delayer 342 longer than in the case where Nch and Pch transistors having a normal channel width are utilized when the connection switching control signal Sck falls (when the inversion delayed signal Srdk rises). Also, by selecting an appropriate, customized size for the channel width as described above for the inverters IVA, IVB, IVC that constitute the inversion delayer 342, it becomes possible for the inversion delayer 342 to have a specific delay time for the fall of the connection switching control signal Sck equal to the earlier-mentioned necessary time.

It should be noted here that in the arrangement shown in FIG. 12, a delay time which is longer than normal is achieved by setting the channel width W in the inversion delayer 342 to a different size from normal; however, the delay time which is longer than normal may be achieved by changing a channel length L or a ratio of the channel width and the channel length, i.e., W/L, to a value which is different from normal, instead of manipulating the channel width.

<1.5 Second Example>

Figure 14:
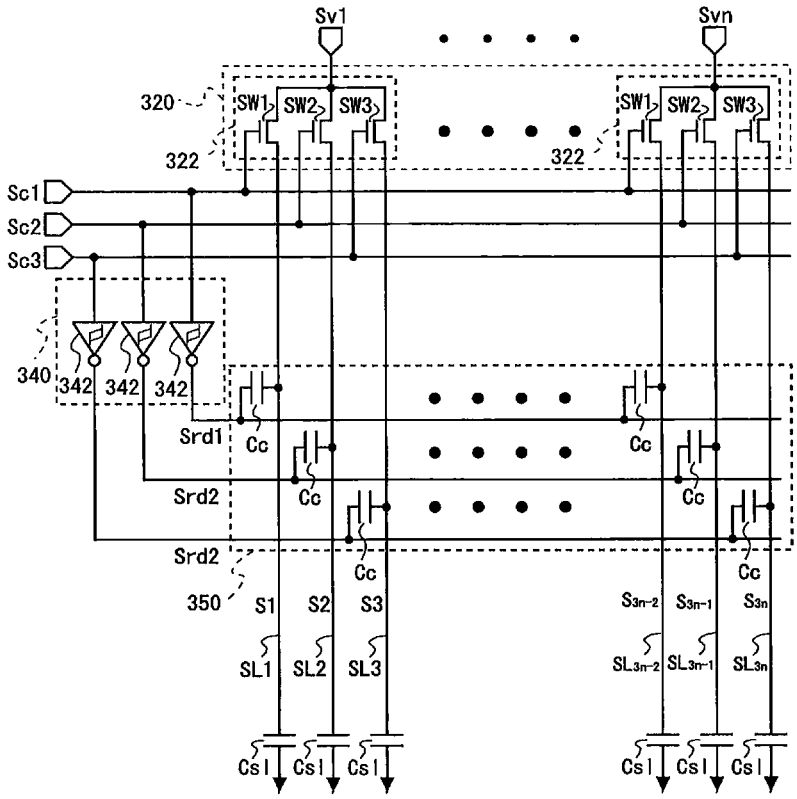
FIG. 14 is a circuit diagram showing a second example for sampling a video signal and correcting its sampled value in the data signal line drive circuit according to the first embodiment.

FIG. 14 is a circuit diagram showing a second example for sampling a video signal Svi and correcting its sampled value in the data signal line drive circuit 300 according to the present embodiment. As shown in FIG. 14, in the present example, each of the inversion delayers 342 in the inversion delaying circuit 340 is provided by a Schmitt trigger inverter. The other parts of the present example than the inversion delaying circuit 340 have identical configurations with the earlier-described configurations shown in FIG. 2 and FIG. 4, and therefore those identical components are indicated with the same reference symbols and description therefor will not be repeated here.

Figure 15:
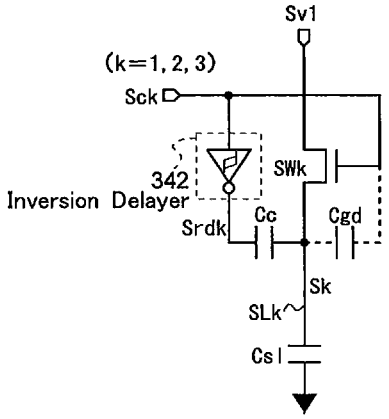
FIG. 15 is a circuit diagram showing a configuration of a unit sample-and-holding circuit in the second example of the first embodiment.

Next, an arrangement and an operation of a primary portion in the present example will be described with a focus on one data signal line SLk. FIG. 15 is a circuit diagram which shows a configuration of a unit sample-and-holding circuit that is a portion of a circuit for sampling a video signal Sv1 and holding its sampled value in one data signal line (focused data signal line) SLk in the present example. This unit sample-and-holding circuit is the unit sample-and-holding circuit shown in (A) of FIG. 6, wherein the inversion delayers 342 are provided by Schmitt trigger inverters.

Figure 16:
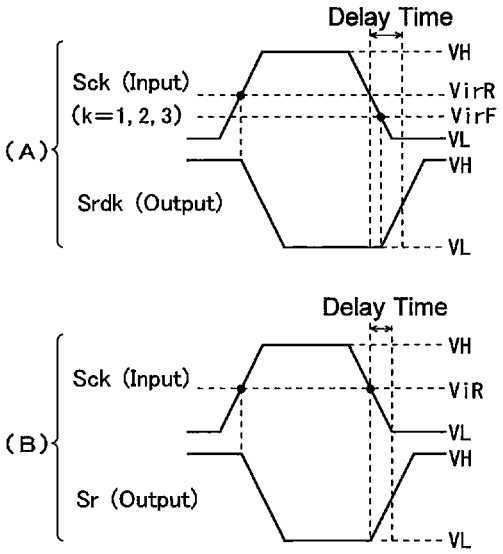
FIG. 16 consists of a signal waveform chart (A) showing an operation of a Schmitt trigger inverter serving as the inversion delayer in the second example of the first embodiment, and a signal waveform chart (B) showing an operation of a conventional inverter.

(A) of FIG. 16 is a signal waveform chart which shows an operation of the Schmitt trigger inverter utilized as the inversion delayer 342 in the present example. (B) of FIG. 16 is a signal waveform chart which shows an operation of an ordinary inverter IV utilized in the conventional unit sample-and-holding circuit shown in (B) of FIG. 6. As shown in (B) of FIG. 16, in the inverter IV which is used in the conventional unit sample-and-holding circuit, the output signal, which is the inverted signal Sr, starts inversion when an input signal (connection switching control signal Sck) reaches a threshold, and the threshold value in the rise time and the threshold value in the fall time are the same value Vir. Contrary to this, as shown in (A) of FIG. 16, in the Schmitt trigger inverter which is used in the unit sample-and-holding circuit according to the present example, the threshold value of the input signal (connection switching control signal Sck) at which the output signal, which is the inversion delayed signal Srdk, starts inversion is different in the rise time and in the fall time. Specifically, when the input signal is in its rise time, the output signal (inversion delayed signal Srdk) is inverted at a threshold value of VirR, which is greater than a threshold value VirF at which the output signal (inversion delayed signal Srdk) is inverted when the input signal is in its fall time. Because of this arrangement, as shown in (A) of FIG. 16 and (B) of FIG. 16, the Schmitt trigger inverter provides a longer delay time than a delay time provided by an ordinary inverter. Therefore, in the present example, the Schmitt trigger inverter described as above is utilized to implement the inversion delayer 342 which delays signal transmission by a length of time which is equal to the earlier-described necessary time.

Figure 17:
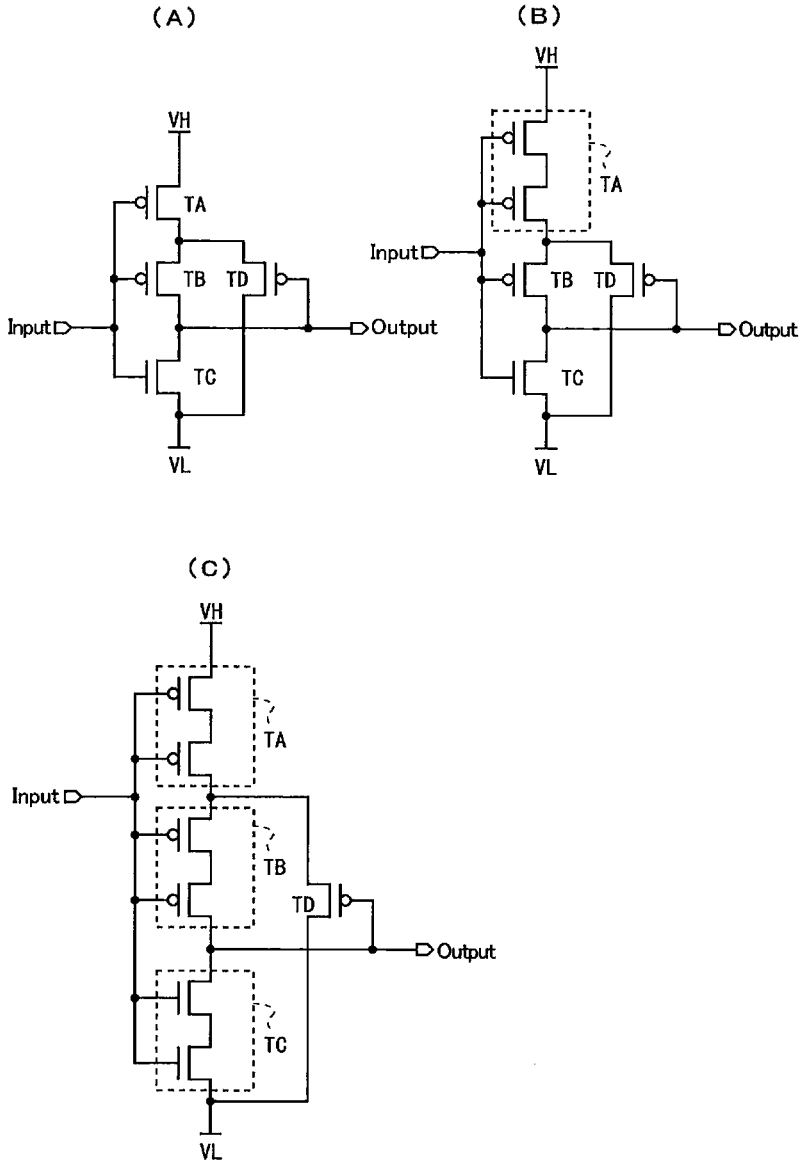
FIG. 17 consists of circuit diagrams (A), (B) and (C) showing a first through third configuration examples of the Schmitt trigger inverter as the inversion delayer in the second example of the first embodiment.

FIG. 17 shows circuit diagrams of a first through a third configuration examples of the Schmitt trigger inverter for use as the inversion delayer 342. Of these, (A) of FIG. 17 shows the first configuration example as a basic configuration of the Schmitt trigger inverter. The Schmitt trigger inverter according to the first configuration example is implemented by connecting Pen transistors TA, TB, TD and an Nch transistor TC as shown in (A) of FIG. 17. In the first configuration example, the Pch transistor TD makes the threshold value of the input signal when the output signal changes from the L level voltage VL to the H level voltage VH, i.e., the input signal's fall time threshold VirF, smaller than the threshold value of the input signal when the output signal changes from the H level voltage VH to the L level voltage VL, i.e., the input signal's rise time threshold value VirR (see (A) of FIG. 16).

(B) of FIG. 17 shows the second example of the Schmitt trigger inverter for use as the inversion delayer 342. In the Schmitt trigger inverter according to the first configuration example, the largest current flow during operation takes place between the source and the drain of the Pch transistors TA and TD. In the second configuration example, the Pch transistor TA is provided by a multi-gate structure transistor (dual-gate structure transistor in the example shown in (B) of FIG. 17) in order to reduce electric current consumption in this path (H level voltage power supply line→transistor TA→transistor TD→L level voltage power supply line). The multi-gate structure transistor has a large ON state resistance between the source and the drain, and therefore the above mentioned current consumption is decreased in the second configuration example.

(C) of FIG. 17 shows the third example of the Schmitt trigger inverter for use as the inversion delayer 342. In the third configuration example, not only the Pch transistor TA but also the Pch transistor TB and the Nch transistor TC are provided by multi-gate structure transistors ((C) of FIG. 17 snows an example of using dual-gate structure transistors). The third configuration example decreases not only the consumption of current but also driving capability of the Schmitt trigger inverter, providing an advantage in increasing the delay time.

Figure 18:
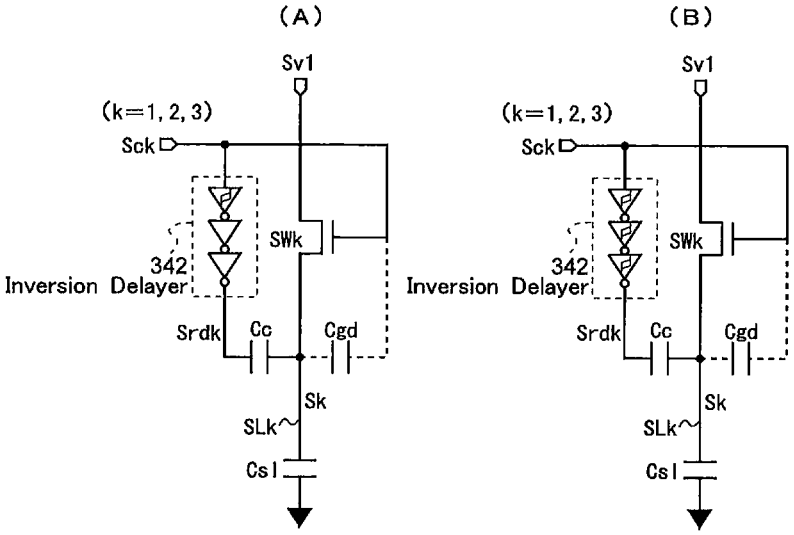
FIG. 18 consists of circuit diagrams (A) and (B) showing unit sample-and-holding circuits each using an inversion delayer of another configuration in the second example of the first embodiment.

FIG. 18 shows circuit diagrams of unit sample-and-holding circuits each using an inversion delayer 342 of still another configuration example according to the present example. In the present configuration examples, the inversion delaying circuit 342 is provided by three or greater odd number of mutually cascade-connected inverters. At least one of the odd number of inverters is provided by a Schmitt trigger inverter. (A) of FIG. 18 shows an example in which the first-stage inverter of the three inverters that constitute the inversion delayer 342 is provided by a Schmitt trigger inverter, whereas (B) of FIG. 18 shows an example in which all of the three inverters that constitute the inversion delayer 342 are provided by Schmitt trigger inverters. According to the present configuration examples as described, it is possible to further increase the delay time compared to the case where the inversion delayer 342 is constituted by one Schmitt trigger inverter (see FIG. 15) and the case where three or a greater odd number of ordinary inverters are cascade-connected (see FIG. 10). It should be noted here that the present example is identical with the one shown in FIG. 15 in its configuration and operation, differing only in the arrangement for the inversion delayer 342. Therefore, other than the inversion delayer 342, those identical parts and components are indicated with the same reference symbols and description therefore will not be repeated.

<1.6 Advantages>

As described, in the present embodiment, the inversion delayed signal Srdk starts its change from the L level voltage VL to the H level voltage VH at a later time point than the time point t1 at which the Nch transistor SWk serving as an analog switch switches from ON state to OFF state (time point at which the control signal Sck reaches its OFF transition voltage Voff). Hence, the voltage change amount ΔVcd (=VH−VL) of the inversion delayed signal Sdk which contributes to correcting the parasitic capacitance rooted data signal line voltage drop is larger than the voltage change amount ΔVc which contributes to the correction in the conventional unit sample-and-holding circuit (see FIG. 7 and FIG. 8). Hence, according to the present embodiment, it is possible to offset the parasitic capacitance rooted data signal line voltage drop ΔVsl with the voltage change amount ΔVcd of the inversion delayed signal Srdk without increasing the capacitance value of the correction capacitance element Cc but by making an appropriate setting as described above (see FIG. 8). Also in the present embodiment, the inversion delayed signal Srdk starts its change from the L level voltage VL to the H level voltage VH at a later time point than the time point t1 and therefore, the amount of delay in the inversion delayed signal Srdk does not influence the correction of the parasitic capacitance rooted data signal line voltage drop. Hence, according to the present embodiment, it is possible to reliably and sufficiently correct the parasitic capacitance rooted data signal line voltage drop resulting from the sampling of the video signal Svi, while reducing increase in layout area.

<2. Second Embodiments>

Next, description will cover a liquid crystal display device according to a second embodiment of the present invention. However, other than its display section and arrangements for sampling the video signal and correcting its sampled value in the data signal line drive circuit, this liquid crystal display device is configured identically with the first embodiment, so the same or corresponding parts or components will be indicated with the same reference symbols, without repeating detailed descriptions thereof.

Figure 19:
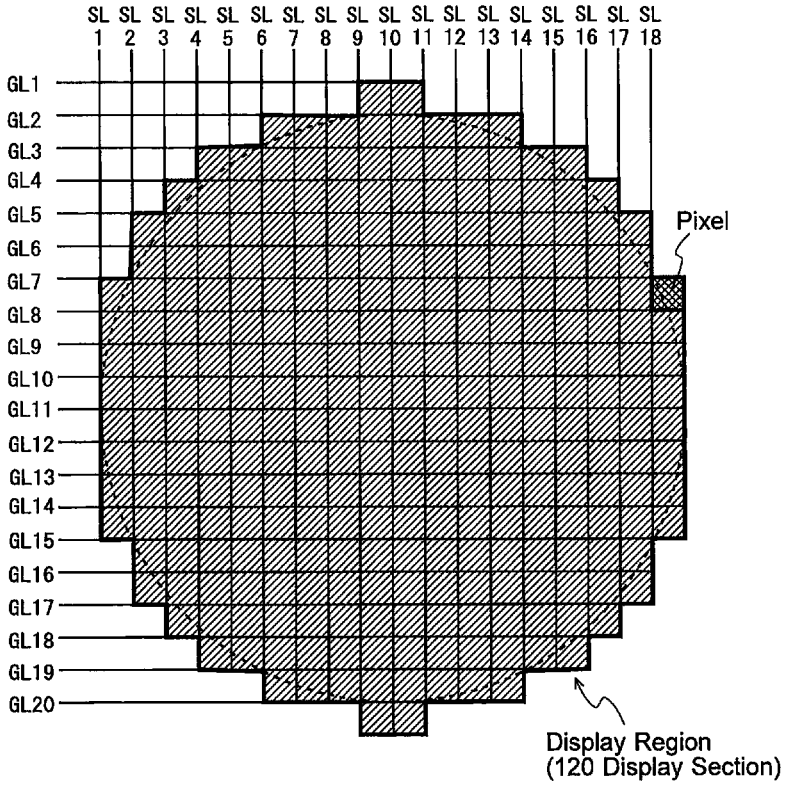
FIG. 19 is a diagrammatic representation showing a configuration of a display section (display region) in a liquid crystal display device according to the second embodiment of the present invention.

FIG. 19 is a diagrammatic representation showing a display section which constitutes a display region in the liquid crystal display device according to the present invention. Note that for the sake of description, the example shown in FIG. 19 has only eighteen data signal lines and twenty scanning signal lines. This liquid crystal display device differs from an ordinary display device which has a rectangular-shaped display region (see FIG. 1 for example), but includes a display section 120 which has a circular display region. For this reason, the data signal lines SL1 through SL18 formed in this display region 120 (hereinafter, the "display region" will be regarded the same as the "display section" and will be indicated with the same reference symbol "120") in the present embodiment includes a plurality of data, signal lines which are different in their length (FIG. 19 shows an example where the data signal lines SL1 through SL10 have different lengths from each other and so do the data signal lines SL10 through SL18).

Figure 20:
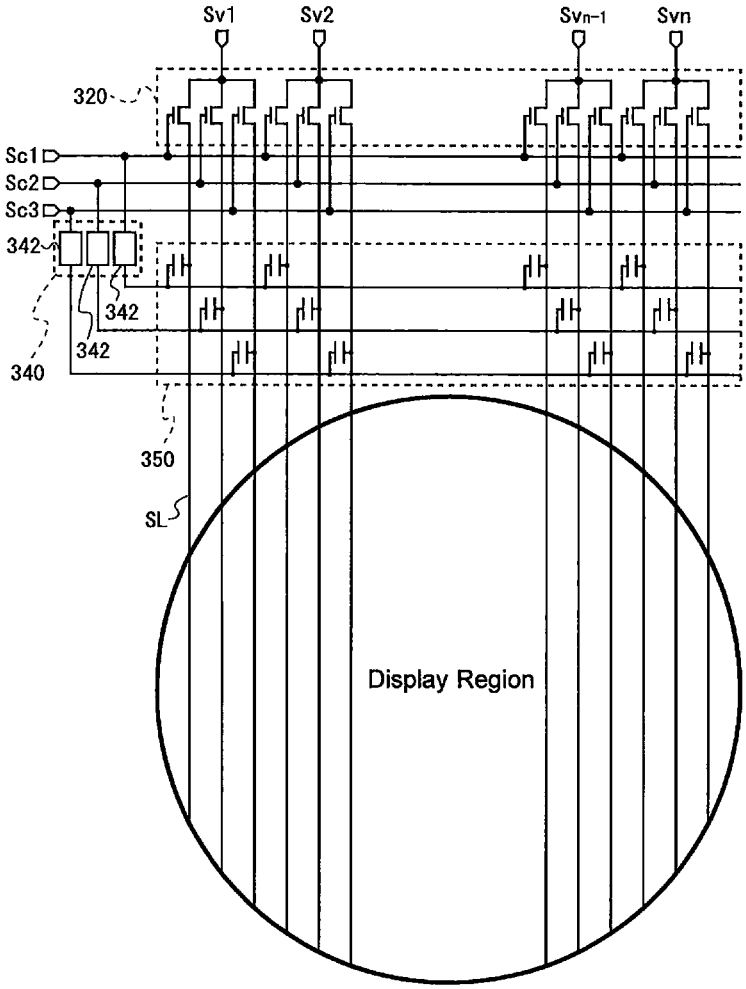
FIG. 20 is a circuit diagram showing a configuration for sampling a video signal and correcting its sampled value in the data signal line drive circuit according to the second embodiment.

FIG. 20 is a circuit diagram which shows an arrangement for sampling the video signal Svi and correcting its sampled value in the data signal line drive circuit according to the present embodiment; in other words, it is a circuit diagram which shows a construction of the demultiplexing circuit 320 and the correction circuit (inversion delaying circuit 340 and correction capacitance circuit 350). As shown in FIG. 20, the demultiplexing circuit 320 as the sampling circuit as well as the inversion delaying circuit 340 and the correction capacitance circuit 350 which constitute the correction circuit in the present embodiment are substantially the same as the first embodiment (see FIG. 4) from circuitry perspectives. In addition, the inversion delayer 342 in the present embodiment may include whichever one of the configuration examples (see FIG. 10, FIG. 15 and FIG. 18) in the first embodiment.

Figure 21:
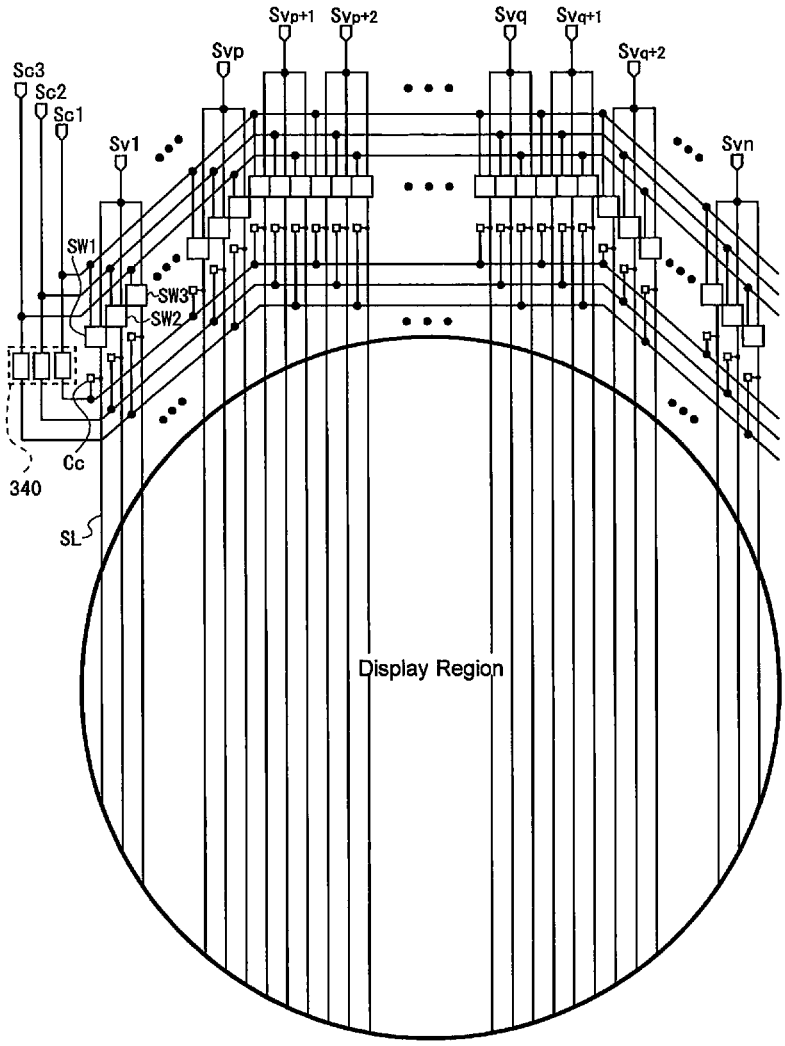
FIG. 21 shows a layout example to show how the circuit of the configuration shown in FIG. 20 can be arranged in the second embodiment.
Figure 22:
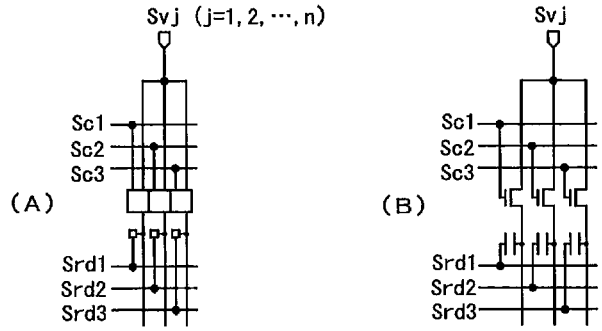
FIG. 22 consists of diagrams (A) and (B) for describing an expression method for one demultiplexer and a correction capacitance circuit corresponding thereto in the data signal line drive circuit according to the second embodiment.

FIG. 21 is a layout example showing how the circuit of the configuration shown in FIG. 20 can be arranged in the present embodiment. As shown in FIG. 21, in the present embodiment, it is preferable that the analog switches (Nch transistors) SW1 through SW3 in the demultiplexing circuit 320 and correction capacitance elements Cc in the correction capacitance circuits 350 are disposed at an outer edge area of the non-rectangular display region (circular region in the present embodiment) along the display region. This allows the display device to follow the shape of the display region, making it possible to decrease the overall size of the electronic appliance. It should be noted here that FIG. 21 uses a slightly different circuit expression from the FIG. 20 for descriptive convenience; specifically, the circuit in (B) of FIG. 22 is expressed in the circuit diagram in (A) of FIG. 22.

Figure 23:
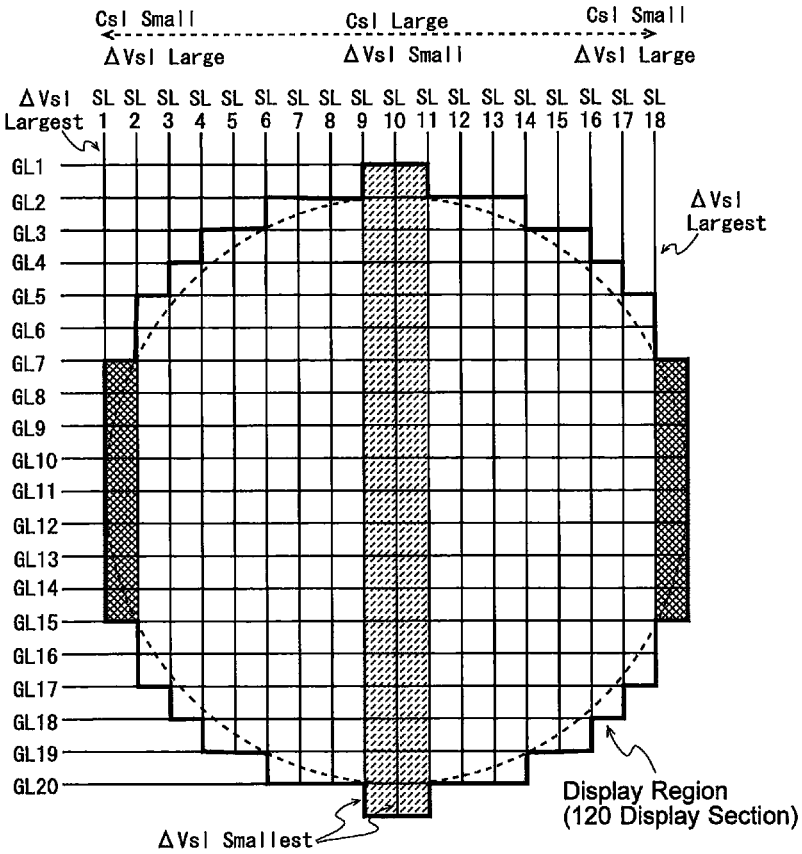
FIG. 23 shows distribution of an amount of drop in data signal line voltage and distribution of capacitance in each data signal line at a time of video signal sampling in the second embodiment.
Figure 24:
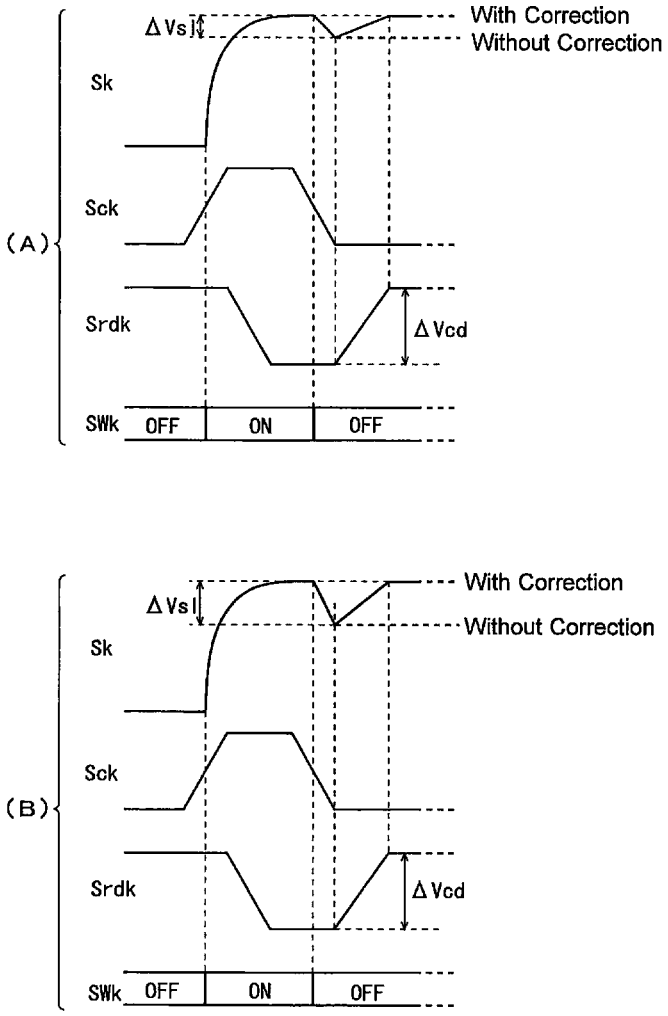
FIG. 24 consists of a signal waveform chart (A) for describing a sampling operation for a data signal line having a large capacitance and a signal waveform chart (B) for describing a sampling operation for a data signal line having a small capacitance, in the second embodiment.

Next, reference will be made to FIG. 23 and FIG. 24 to describe an operation of the present embodiment.

In the display region 120, the data signal line capacitance Csl is formed between the data signal line SL itself and such components as the TFTs 12 in the pixel formation portion 10 connected thereto and intersections with the scanning signal lines GL. The data signal line capacitance Csl becomes greater if the number of such TFTs 12 and intersections increases. This means that in the present embodiment which includes a circular display region as shown in FIG. 21, data signal line capacitance Csl is greatest in a central area of the display region as shown in FIG. 23, i.e., in the area served by the longest data signal lines SL, whereas it is smallest in two end areas of the display region, i.e., the areas served by the shortest data signal lines SL. As a consequence, the parasitic capacitance rooted data signal line voltage drop ΔVsl when sampling the video signal Svi by the demultiplexing circuit 320 is smallest in the central area of the display region and largest in the two end areas of the display region. Therefore, in oases where the parasitic capacitance rooted data signal line voltage drop ΔVsl is not corrected, or in cases where correction is made but not correspondingly to the distribution pattern of the parasitic capacitance rooted data signal line voltage drop ΔVsl as shown in FIG. 23, it is not possible to make appropriate settings of the voltage (common voltage Vcom) at the common electrode Ec such that the data signal line voltage drop ΔVsl is uniformly compensated over the entire display region in the display section 120. A result is local flicker (screen flicker).

Contrary to this, in the present embodiment, as understood from the arrangement of the unit sample-and-holding circuit shown in (A) of FIG. 6 and others, the size of the parasitic capacitance rooted data signal line voltage drop ΔVsl is proportional to a ratio of the parasitic capacitance Cgd to a total capacitance of the focused data signal line SLk (a sum of the data signal line capacitance Csl, the parasitic capacitance Cgd and the correction capacitance Cc) given by Cgd/(Csl+Cgd+Cc), whereas the amount of correct ion on the data signal line voltage Vsl by the voltage change amount ΔVcd of the inversion delayed signal Srdk is proportional to a ratio of the correction capacitance Cc to the total capacitance of the focused data signal line Slk given by Cc/(Csl+Cgd+Cc). Thus, as shown in (A) of FIG. 24, an area of the display region where the signal line capacitance Csl is large has a small parasitic capacitance rooted data signal line voltage drop ΔVsl, but the amount of correction on the data signal line voltage Vsl by the voltage change amount ΔVcd is accordingly small and therefore the voltage drop ΔVsl is offset. Also, as shown in (B) of FIG. 24, an area of the display region where the signal line capacitance Csl is small has a large parasitic capacitance rooted data signal line voltage drop ΔVsl, but the amount of correction on the data signal line voltage Vsl by the voltage change amount ΔVcd is accordingly large to offset the voltage drop ΔVsl. As described, according to the present embodiment, even if the display region is circular or otherwise non-rectangular and therefore the data signal lines SL are different in their length in the display region (even if data signal line capacitance Csl is different from one data signal line SL to another), parasitic capacitance rooted data signal line voltage drop ΔVsl is appropriately corrected over the entire display region, and therefore the screen flicker as described above is suppressed.

One idea for further suppressing the screen flicker is to narrow the channel width W of each Nch transistor Swk which serves as an analog switch in the demultiplexing circuit 320. Decreasing the channel width W decreases the parasitic capacitance Cgd, so the data signal line voltage drop ΔVsl decreases all over the display region, and screen flicker is further suppressed as a result. It must be understood, however, that decreasing the channel width W of the Hon transistor SWk which serves as an analog switch decreases charging ability and electrostatic breakdown voltage of the data signal. line SL, and therefore there is a certain limitation to the idea of decreasing the channel width W.

The display region is circular in the present embodiment. However, the present invention is also applicable, with the same advantages, to any case where the display region is non-rectangular other than circular and therefore the data signal lines SL are different from each other in their length (i.e., the data signal line capacitances Csl are different from each other).

<3. Third Embodiment>

Next, description will cover a liquid crystal display device according to a third embodiment of the present invention. However, other than its display section and arrangements for sampling the video signal and correcting its sampled value in the data signal line drive circuit, this liquid crystal display device is configured identically with the first embodiment, so the same or corresponding parts or components will be indicated with the same reference symbols, without repeating detailed descriptions thereof.

<3.1 First Example>

Figure 25:
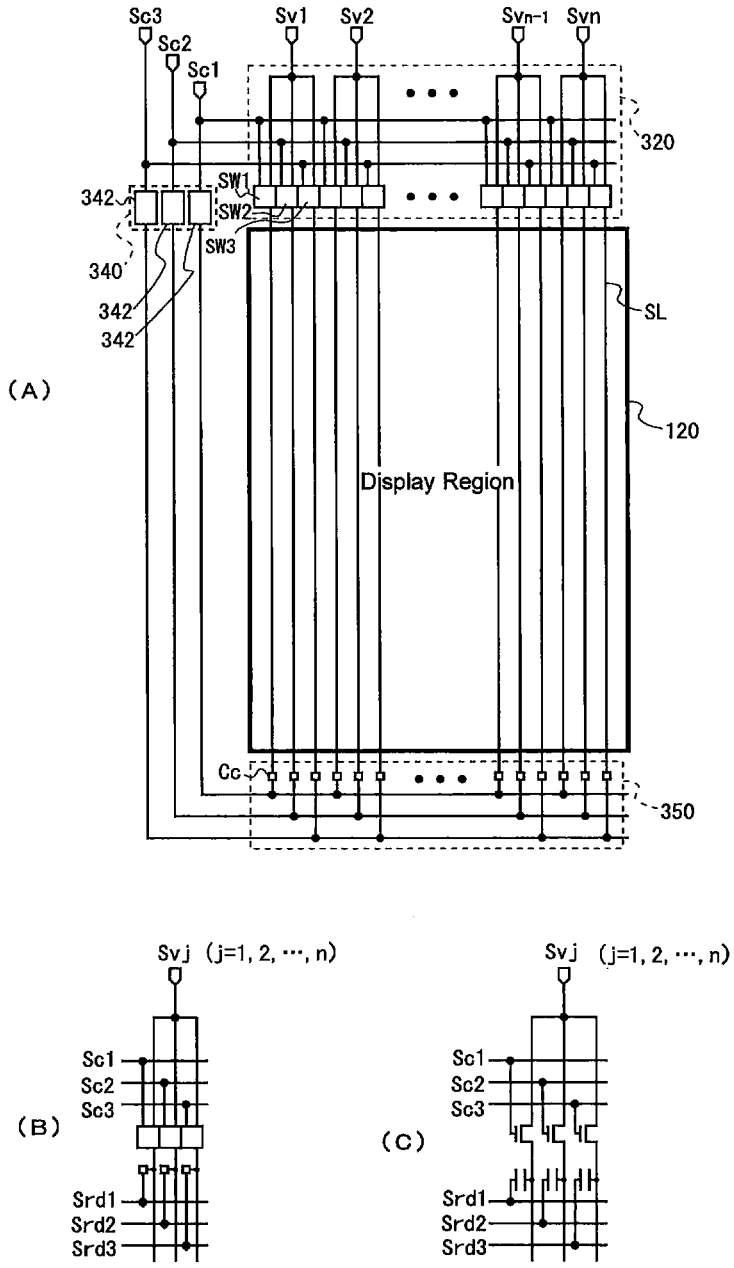
FIG. 25 consists of circuit diagrams (A), (B), and (C) showing a first example for sampling a video signal and correcting its sampled value in the data signal line drive circuit according to a third embodiment of the present invention.

FIG. 25 is a circuit diagram showing a first example for sampling a video signal and correcting its sampled value in the data signal line drive circuit according to the present embodiment. In this first example, the correction capacitance circuit 350 is disposed on the opposite side from the side where the demultiplexing circuit 320 is, with respect to the display region (the display section 120). Of the two ends in each data signal line SL, the analog switch (Nch transistor) SWk (k=1, 2, 3) is connected to one end and the correction capacitance element Cc is connected to the other end. Note that (A) of FIG. 25 uses a slightly different circuit expression from the FIG. 4 for descriptive convenience; specifically, the circuit in (C) of FIG. 25 is expressed in the circuit diagram in (B) of FIG. 25.

In cases where all of the correction capacitance elements Cc are disposed on the same side as the analog switches SWk (k=1, 2, 3) with respect to the display region like in the first embodiment (FIG. 1, FIG. 2, FIG. 4, etc.), an area of the display region (the display section 120) on the analog switch side along the outer edge must be available for a purpose of wiring the correction capacitance elements Cc to the inversion delaying circuit 340 and, for a purpose of disposing the correction capacitance elements Cc themselves, resulting in decreased freedom of layout. Also, since wiring density increases in this case, routing of the wiring has to be complicated and this can lead to increased formation of parasitic capacitance. Contrary to this, according to the first example in the present embodiment, each correction capacitance element Cc is disposed on the side opposite from the side where the analog switch SWk is disposed, with respect to the display region. This frees, in areas on the analog switch side along the outer edge of the display region, an area which is otherwise occupied by the correction capacitance elements Cc and an area which is otherwise occupied by wiring for the transmission of inversion delayed signal Srdk. As a result, it becomes possible to make layout with a high level of freedom without making complicated wiring.

Although FIG. 25 shows an example in which the inversion delaying circuit 340 is disposed right next to the demultiplexing circuit 320 which includes the analog switches SWk (i.e., disposed adjacently to the demultiplexing circuit 320 in a direction perpendicular to the data signal lines SL), the inversion delaying circuit 340 may instead be disposed at a different location available in the outer edge area of the display region 120.

<3.2 Second Example>

Figure 26:
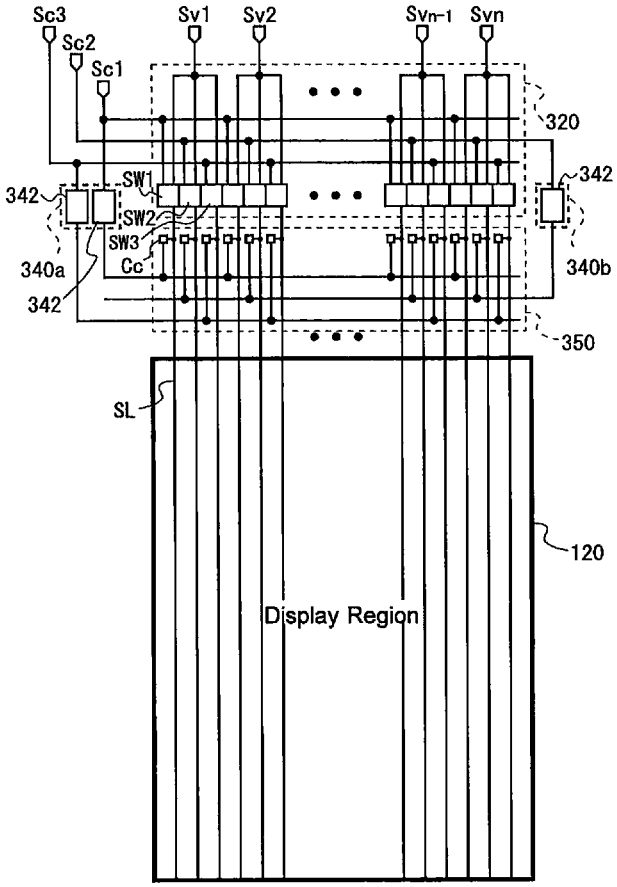
FIG. 26 is a circuit diagram showing a second example for sampling a video signal and correcting its sampled value in the data signal line drive circuit according to the third embodiment.

FIG. 26 is a circuit diagram showing a second example for sampling a video signal and correcting its sampled value in the data signal line drive circuit according to the present embodiment. In the first embodiment, the three inversion delayers 342 which constitute the inversion delaying circuit 340 are disposed as a single circuit block (FIG. 4, FIG. 9, FIG. 14). These three inversion delayers 342 may be disposed in a distributed fashion. From this view point, the second example has an arrangement shown in FIG. 26. Specifically, the inversion delaying circuit 340 in the first embodiment is divided into two, i.e., an inversion delaying circuit 340*a* which includes two inversion delayers 342, and an inversion delaying circuit 340*b* which includes one inversion delayer 342; and these two inversion delaying circuits 340*a*, 340*b* are disposed on the left and right sides as in the figure (perpendicularly to the data signal lines SL, adjacent to the two respective ends of the demultiplexing circuit 320). According to the second example as described, it is possible to ensure that areas necessary for circuit disposition in the outer edge area of the display region 120 are not concentrated on one of the left and right side as in the drawing (not concentrated on one of the two sides in the direction perpendicular to the data signal lines SL).

Although FIG. 26 shows an example in which the inversion delaying circuits 340*a*, 340*b* are disposed right next to the demultiplexing circuit 320 which includes the analog switches SWk (i.e., disposed adjacently to the demultiplexing circuit 320 in a direction perpendicular to the data signal lines SL), the inversion delaying circuits 340*a*, 340*b* may instead be disposed in a distributed fashion at different locations available in the outer edge areas of the display region 120.

3.3 Third Example

Figure 27:
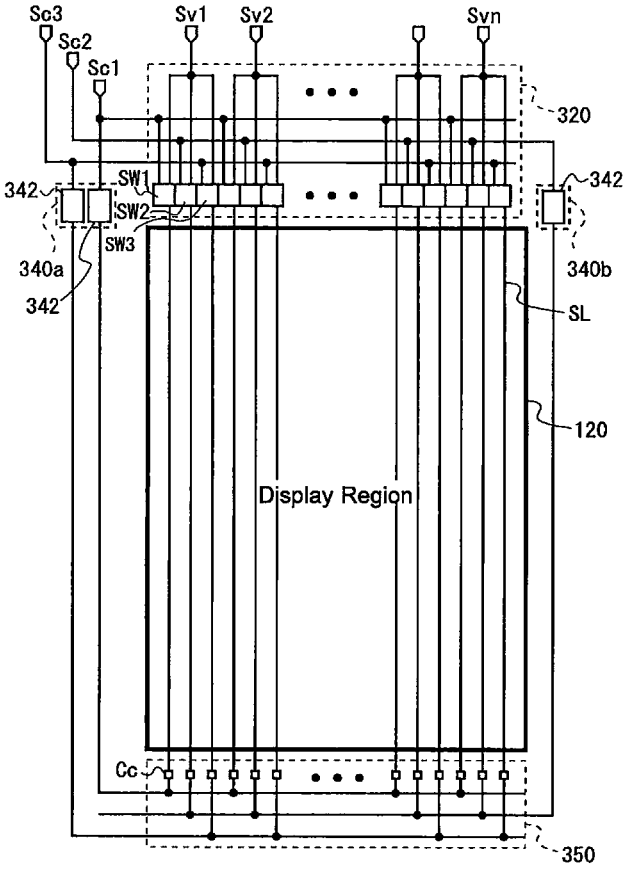
FIG. 27 is a circuit diagram showing a third example for sampling a video signal and correcting its sampled value in the data signal line drive circuit according to the third embodiment.

FIG. 27 is a circuit diagram shewing a third example for sampling a video signal and correcting its sampled value in the data signal line drive circuit according to the present embodiment. The present example combines characteristics in the first example (FIG. 25) and a characteristic in the second example (FIG. 26). In other words, the correction capacitance circuit 350 is disposed on the opposite side from the side where the demultiplexing circuit 320 is, with respect to display region 120; of the two ends in each data signal line SL, the analog switch SWk (k=1, 2, 3) is connected to one end and the correction capacitance element Cc is connected to the other end; and together with these features, the three inversion delayers 342 are disposed in a distributed fashion.

The third example described above offers the same advantages as offered by the first and the second examples. In addition, it is possible to dispose wiring between the inversion delaying circuits 340*a*, 340*b* and each correction capacitance element Cc, and wiring between input terminals of the connection switching control signal Sck (k=1, 2, 3) and the inversion delaying circuits 340*a*, 340*b* evenly on the left and the right sides in the drawing (evenly on both sides of the direction perpendicular to data signal line SL).

Although FIG. 27 shows an example in which the inversion delaying circuits 340*a*, 340*b* are disposed right next to the demultiplexing circuit 320 which includes the analog switches SWk (i.e., disposed adjacently to the demultiplexing circuit 320 in a direction perpendicular to the data signal lines SL), the inversion delaying circuits 340*a*, 340*b* may instead be disposed in a distributed fashion at different locations available in the outer edge are of the display region 120.

<4. Fourth Embodiment>

Next, description will cover a liquid crystal display device according to a fourth embodiment of the present invention. However, other than its display section and arrangements for sampling the video signal and correcting its sampled value in the data signal line drive circuit, this liquid crystal display device is configured identically with the first embodiment, so the same or corresponding parts or components will be indicated with the same reference symbols, without repeating detailed descriptions thereof.

In the present embodiment, characteristics in the third embodiment shown in FIG. 25 through FIG. 27 are incorporated in the second embodiment shown in FIG. 19 through FIG. 21.

Figure 28:
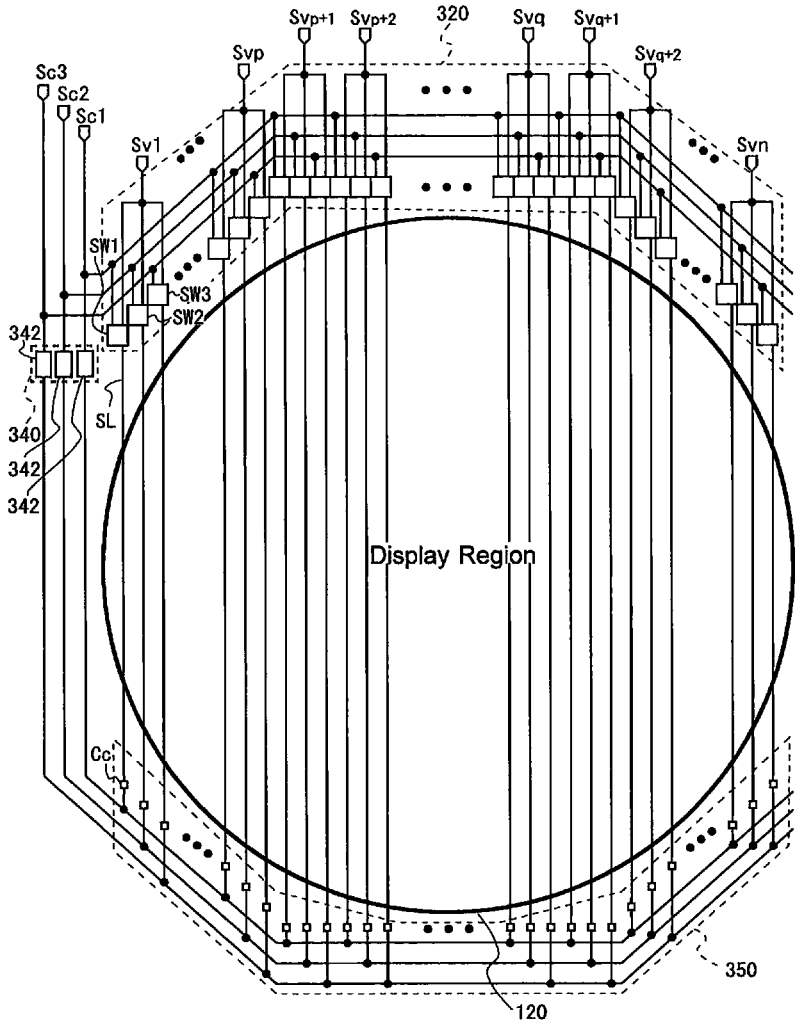
FIG. 28 is a circuit diagram showing a first example for sampling a video signal and correcting its sampled value in the data signal line drive circuit according to a fourth embodiment of the present invention.

Specifically, FIG. 28 is a circuit diagram showing a first example for sampling the video signal and correcting its sampled value in the data signal line drive circuit in a liquid crystal display device according to the present embodiment. In this first example, the arrangement in the second embodiment which includes a circular display region and is shown in FIG. 21 is modified as follows: Specifically, the correction capacitance circuit 350 is disposed on the opposite side from the side where the demultiplexing circuit 320 is, with respect to display region 120; and of the two ends in each data signal line SL, the analog switch SWk (k=1, 2, 3) is connected to one end and the correction capacitance element Cc is connected to the other end. The first example in the present embodiment as described also offers the same advantages as offered by the first example in the third embodiment (FIG. 25), and it is possible to make the same variations in disposing the inversion delaying circuit 340.

Figure 29:
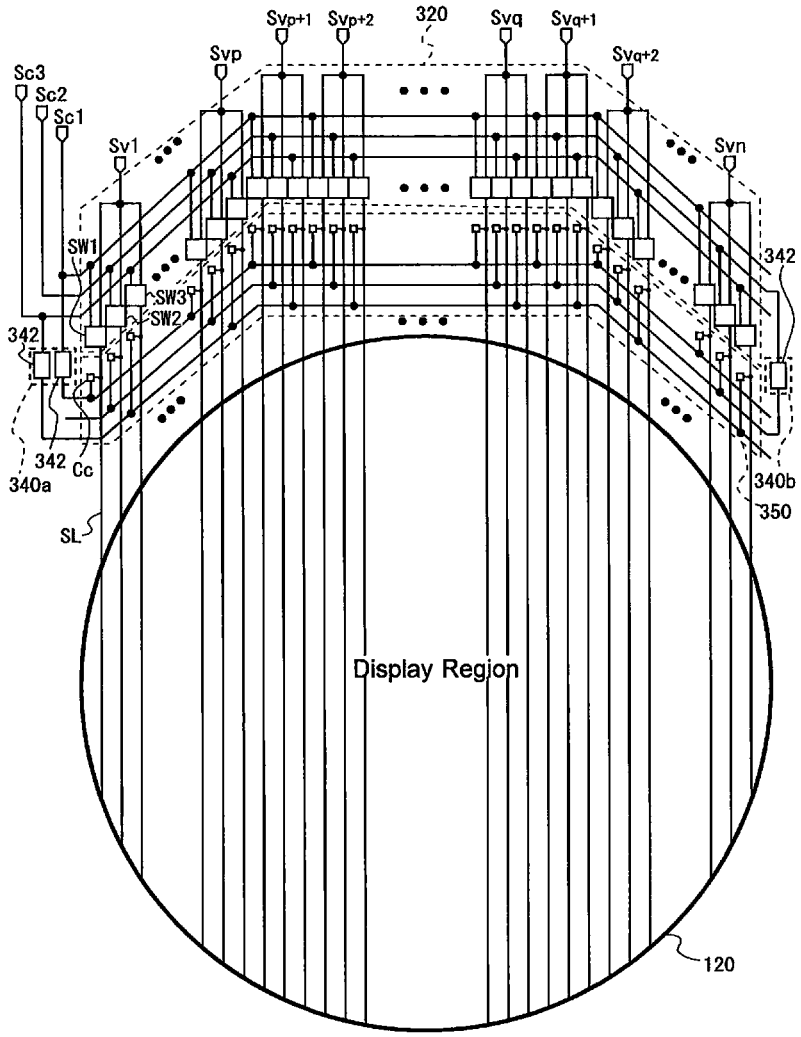
FIG. 29 is a circuit diagram showing a second example for sampling a video signal and correcting its sampled value in the data signal line drive circuit according to the fourth embodiment.

FIG. 29 is a circuit diagram showing a second example for sampling the video signal and correcting its sampled, value in the data signal line drive circuit in a liquid crystal display device according to the present embodiment. In this second example, the arrangement in the second embodiment which includes a circular display region and is shown in FIG. 21 is modified as follows: Specifically, the three inversion delayers 342 which constitute the inversion delaying circuit 340 are disposed in a distributed fashion: In the example shown in FIG. 29, the inversion delaying circuit 340 is divided into two, i.e., an inversion delaying circuit 340*a* which includes two inversion delayers 342, and an inversion delaying circuit 340*b* which includes one inversion delayer 342; and these two inversion delaying circuits 340*a*, 340*b* are disposed on the left and right sides as in the drawing (perpendicularly to the data signal lines SL, adjacent the respective ends of the demultiplexing circuit 320). The second example in the present embodiment as described also offers the same advantages as offered by the second example in the third embodiment (FIG. 26), and it is possible to make the same variations in disposing the inversion delaying circuit 340.

Figure 30:
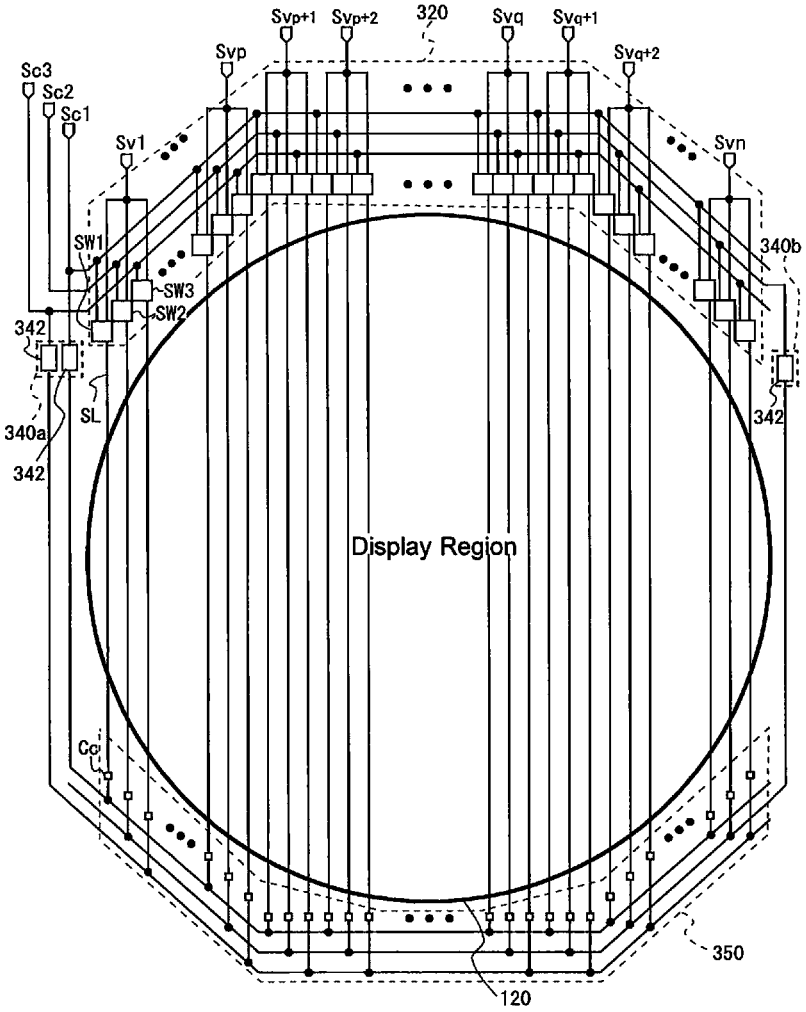
FIG. 30 is a circuit diagram showing a third example for sampling a video signal and correcting its sampled value in the data signal line drive circuit according to the fourth embodiment.

FIG. 30 is a circuit diagram showing a third example for sampling the video signal and correcting its sampled value in the data signal line drive circuit in a liquid crystal display device according to the present embodiment. In this third example, the arrangement in the second embodiment which includes a circular display region and is shown in FIG. 21 is modified as follows: Specifically, the correction capacitance circuit 350 is disposed on the opposite side from the side where the demultiplexer 320 is, with respect to display region 120; of the two ends in each data signal line SL, the analog switch SWk (k=1, 2, 3) is connected to one end and the correction capacitance element Cc is connected to the other end; and together with these features, the three inversion delayers 342 are disposed in a distributed fashion. The third example in the present embodiment as described also offers the same advantages as offered by the third example in the third, embodiment (FIG. 27), and it is possible to make the same variations in disposing the inversion delaying circuit 340.

<5. Structure of Correction Capacitance Element>

Figure 31:
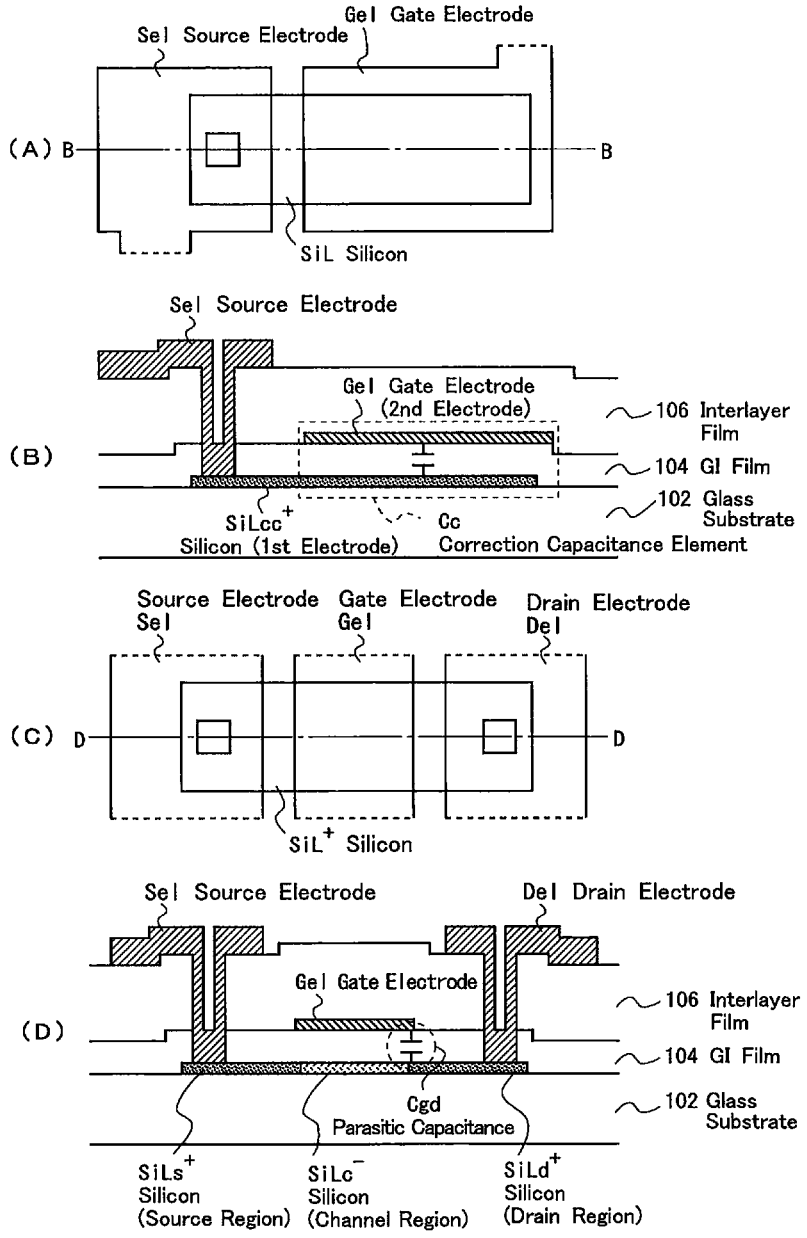
FIG. 31 consists of a plan view (A) showing a suitable structure of a correction capacitance element in each embodiment of the present invention, a sectional view (B) thereof, a plan view (C) showing a structure of a thin film transistor, and a sectional view (D) thereof.

For any of the above-described embodiments according to the present invention, there is no specific limitation to the structure of each correction capacitance element Cc in the correction capacitance circuit 350; however, from a consideration into parasitic capacitance variation which results from manufacturing processes of the transistor SWk (k=1, 2, 3) as an analog switch, it is preferable that the correction capacitance element Cc has the following structure:

(A) of FIG. 31 is a plan view showing a suitable structure of the correction capacitance element Cc in each embodiment; (B) of FIG. 31 is a sectional view showing the suitable structure, representing a sectional view taken in a line B-B in (A) of FIG. 31, (C) of FIG. 31 is a plan view showing a structure of the TFT formed in the display panel 100 in each embodiment; (D) of FIG. 31 is a sectional view showing the structure of the TFT, representing a sectional view taken in a line D-D (C) of FIG. 31. When this suitably structured correction capacitance element Cc is utilized in any of the above described embodiments, the correction capacitance element Cc is formed on a glass substrate as a constituent component of the display panel 100, together with the TFT 12 that serves as the pixel switch in the pixel formation portion 10, the TFT that is a transistor constituting the analog switch SWk in the demultiplexing circuit 320 and other components, integrally therewith in the same process.

First, the structure of the TFT will be described. As shown in (C) of FIG. 31 and (D) of FIG. 31, the TFT includes, as part of a silicon layer SiL formed on a glass substrate 102 which is a constituent component of the display panel 100, a source region SiLs+ provided by one of two regions SiLs+, SiLd+ having a high impurity concentration; a drain region SiLd+ provided by the other of the two regions; a channel region SiLc− sandwiched between these source region SiLs+ and the drain region SiLd+ and having a low impurity concentration; and in addition, a gate electrode Gel formed on the silicon layer SiL to oppose to the channel region SiLc− via a gate insulation film (hereinafter called "GI film") 104. Further, the TFT includes a source electrode Sel and a drain electrode Del made on an interlayer film 106 which is formed on the gate electrode Gel. The source electrode Sel is electrically connected with the source region SiLs+ through a contact hole, whereas the drain electrode Del is electrically connected with the drain region SiLd+ through a contact hole.

Next, the structure of the correction capacitance element Cc will be described. As shown in (A) of FIG. 31 and (8) of FIG. 31, the correction capacitance element Cc includes: an electrode (first terminal) provided by silicon SiLcc+ of a predetermined region of the high impurity concentration in the silicon layer which is formed (to implement the channel region of the TFT and others) on the glass substrate 102 as a constituent component of the display panel 100; and another electrode (the second terminal) provided by the gate electrode Gel which is formed to oppose to the silicon SiLcc+ that represents the first electrode via the gate insulation film (GI film ) 104 on the silicon layer. This gate electrode Gel is formed with the interlayer film 106 thereon.

Now, consider that the GI film 104 is subject to variation in manufacturing processes of the TFT. As understood from (D) of FIG. 31, accordingly to this variation, the capacitance value of the parasitic capacitance Cgd also varies. Specifically, if the GI film 104 is formed thinner than normal, the capacitance value of the parasitic capacitance Cgd becomes accordingly larger, whereas it becomes accordingly smaller if the GI film 104 is formed thicker than normal. When the capacitance value of the parasitic capacitance Cgd varies as described, the amount of the parasitic capacitance rooted data signal line voltage drop (ΔVsl) also varies accordingly. This means that there can be cases where the parasitic capacitance rooted data signal line voltage drop is not corrected appropriately.

Contrary to this, in cases where the correction capacitance element Cc as shown in (A) of FIG. 31 and (B) of FIG. 31 is utilized, the correction capacitance element Cc and the TFT are formed together in the same process. In other words, in this correction capacitance element Cc, the first electrode (SiLcc+), the second electrode (Gel), and the insulation film (104) between these two electrodes are respectively provided by a predetermined portion of the silicon layer formed for formation of the channel region SiLc− in the TFT, a predetermined portion of the conductive layer formed for formation of the gate electrode Gel therein, and a predetermined portion of the insulation layer formed for formation of the GI film therein. Therefore, as the GI film 104 varies, the capacitance value of the correction capacitance element Cc also varies identically. As a result, if the parasitic capacitance rooted data signal line voltage drop is large, the capacitance value of the correction capacitance element Cc is also large accordingly, and the amount of correction made by the inversion delayed signal Srdk to the data signal line voltage is also large. Likewise, if the parasitic capacitance rooted data signal line voltage drop is small, the capacitance value of the correction capacitance element Cc is also small accordingly, and the amount of correction made by the inversion delayed signal Srdk to the data signal line voltage is also small. Therefore, even if the size of the parasitic capacitance rooted data signal line voltage drop (ΔVsl) varies as the thickness of the GI film 104 varies due to variation in manufacturing processes, it is possible to appropriately correct the data signal line voltage drop and make the data signal line SL3(i−1)+k hold a voltage which is substantially equal to the voltage of the video signal Svi, with the correction circuit (the inversion delaying circuit 340 and the correction capacitance circuit 350) in each embodiment (i=1 through n; k=1, 2, 3).

<6. Variations>

The present invention is not limited to any of the embodiments described above, but may be varied in many ways within the scope of the present invention. The present invention also includes any combinations of a plurality of the embodiments described thus far, as far as there is no conflict arising from the combination.

Figure 32:
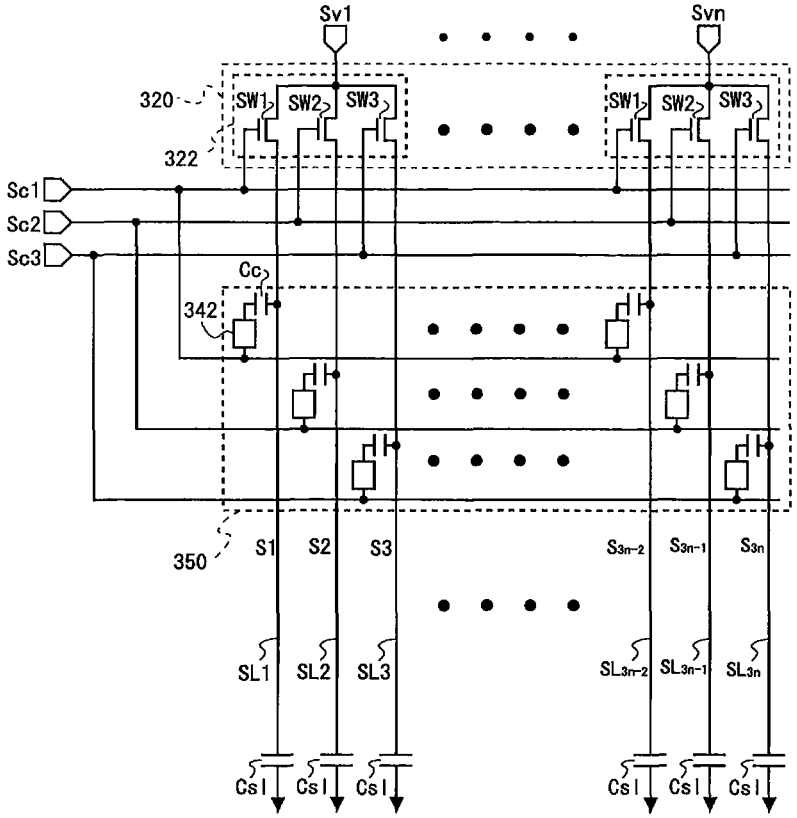
FIG. 32 is a circuit diagram showing a first variation of each embodiment of the present invention.

For example, each of the above-described embodiments has three inversion delayers 342 to generate the inversion delayed signal Srd1 through Srd3 which are to be supplied to the data signal line SL1 through SL3*n* via the correction capacitance element Cc (FIG. 4, FIG. 9, FIG. 14, FIG. 20, FIG. 25 through FIG. 27, etc.); but instead of this, there may be an arrangement as shown in FIG. 32, in which each data signal line SL3(i−1)+k has an inversion delayer 342, and an inversion delayed signal Srdk generated by that inversion delayer 342 is applied to the data signal line SL3(i−1)+k via the correction capacitance element (i=1 through n; k=1, 2, 3). According to the arrangement as the above, it is possible to dispose inversion delaying circuits 342 in a distributed fashion, which improves the level of freedom in circuit disposition. Also, the arrangement makes it possible to vary settings in these inversion delayers 342 for each data signal line SL, to vary the amount of correction of the data signal line voltage for each data signal line SL. For example, in cases where each transistor SWk connected to the data signal line SL as art analog switch has a different channel width W from each other, the amount of voltage drop differs from one data signal line SL to another; however, by changing the output voltage of each inversion delayer 342 it becomes possible to make correction accordingly to the amount of voltage drop in each data signal line SL.

In each of the embodiments, the inverter which constitutes the inversion delayer 342 has been described as a CMOS inverter which makes use of an Nch transistor and Pch transistor (see FIG. 12 and FIG. 17); however, the inversion delayer 342 may be constituted by an inverter which makes use of only one of an Nch transistor and a Pch transistor.

Figure 33:
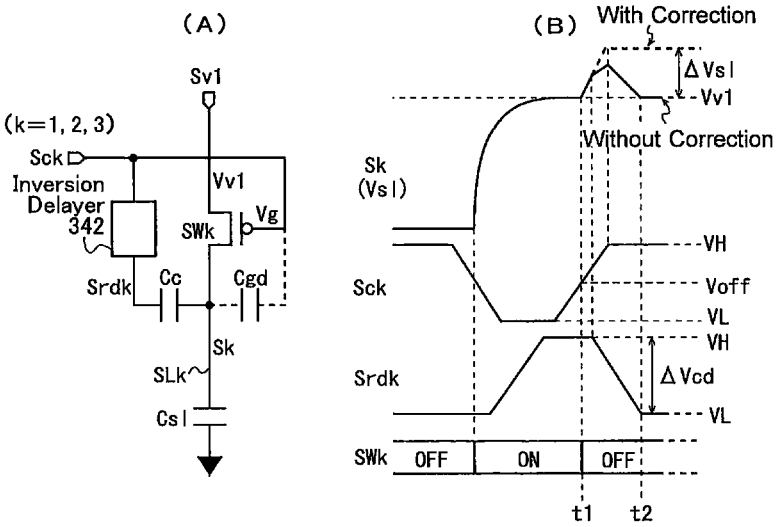
FIG. 33 consists of a circuit diagram (A) and a signal waveform chart (B) for describing a second variation of each embodiment of the present invention.
Figure 34:
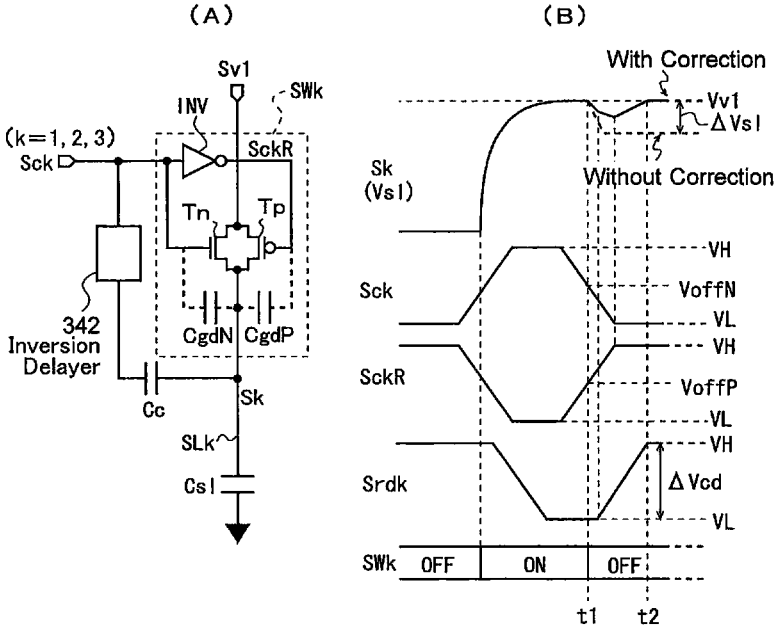
FIG. 34 consists of a circuit diagram (A) and a signal waveform chart (B) for describing a third variation of each embodiment of the present invention.

Again in each embodiment, the analog switch SWk in the demultiplexing circuit 320 as a sampling circuit is provided by an Men transistor (FIG. 4, FIG. 9, FIG. 14, FIG. 20, etc.); alternatively however, it may be provided by a Pch transistor as shown in (A) of FIG. 33. (A) of FIG. 33 shows a unit sample-and-holding circuit when the analog switch SWk is provided by a Pch transistor. As shown in (B) of FIG. 33, the connection switching control signal Sck in this case differs from the connection switching control signal Sck in each of the embodiments in that the L level voltage VL and the H level voltage VH are swapped with each other. Accordingly, the voltage change in the connection switching control signal Sck at the time when the Pch transistor SWk as an analog switch change its state from ON state to OFF state, works in a direction to raise the voltage Vsl of the data signal line SLk via the parasitic capacitance Cgd (hereinafter, this rise in the data signal line voltage will be called "parasitic capacitance rooted data signal line voltage rise"). the inversion delayer 342 generates the inversion delayed signal Srdk as shewn in (B) of FIG. 33, and supplies the signal to the the second terminal of the correction capacitance element Cc (the terminal which is not connected to the data signal line SLk, of the two terminals of the correction capacitance element Cc). As a consequence, the change amount ΔVcd=VH−VL when the inversion delayed signal Srdk changes from the H level voltage VH to the L level voltage VL works in the direction to correct the parasitic capacitance rooted data signal line voltage rise ΔVsl. Therefore, in this case again, it is possible to offset the data signal line voltage rise ΔVsl by appropriately setting the capacitance value of the correction capacitance element Cc as has been described. Therefore, arrangements in which the analog switch SWk is provided by a Pch transistor also offers the same advantages as offered toy each of the embodiments covered earlier, In each of the embodiments, the analog switch SWk provided by an Nch transistor (FIG. 4, FIG. 9, FIG. 14, FIG. 20, etc.) may be replaced with an analog switch SWk as shown in (A) of FIG. 34, provided by a Pch transistor Tp and an Nch transistor Tn connected in parallel with each other (hereinafter, an analog switch according to this arrangement will be called "CMOS analog switch"). (A) of FIG. 34 shows a unit sample-and-holding circuit when the analog switch SWk is provided by a CMOS analog switch. In this case, the Nch transistor Tn as a constituent part of this CMOS analog switch has its gate terminal supplied with the connection switching control signal Sck, whereas the Pch transistor Tp has its gate terminal supplied with a signal SckR which is a signal obtained by logically inverting the connection switching control signal Sck through the inverter INV.

As shown in (B) of FIG. 34, the voltage change of the connection switching control signal Sck and the voltage change of the logical inversion signal SckR at the time when the Pch transistor Tp and the Nch transistor Tn which constitute the analog switch SWk change their state from ON state to OFF state, cause a change (drop or rise) in the voltage Vsl of the data signal line SLk via respective parasitic capacitances CgdN and CgdP ((B) of FIG. 34 shows a case where the change occurs in the dropping direction). The direction of change is dictated by such factors as the parasitic capacitance CgdN of the Nch transistor Tn, the parasitic capacitance CgdP of the Pch transistor Tp, the amount of delay of logically inverted signal SckR with respect to the connection switching control signal Sck, and so on. The direction of change can be observed in computer simulation for example. In the case where the direction of change is in the dropping direction, the inversion delayer 342 generates an inversion delayed signal Srdk as shown in (B) of FIG. 34, and supplies the signal to the second terminal of the correction capacitance element Cc (the terminal which is not connected to the data signal line SLk, of the two terminals of the correction capacitance element Cc). As a consequence, the change amount ΔVcd=VH−VL when the inversion delayed, signal Srdk changes from the L level voltage VL to the H level voltage VH works in the direction to correct the parasitic capacitance rooted data signal line voltage drop ΔVsl. Therefore, in this case again, it is possible to offset the data signal line voltage drop ΔVsl by appropriately setting the capacitance value of the correction capacitance element Cc as has been described. As understood from the above, arrangements in which the analog switch SWk is provided by a CMOS analog switch which is constituted by a Pch transistor Tp and an Nch transistor Tn also offer the same advantages as offered by each of the embodiments covered earlier.

In cases where the voltage change of the connection switching control signal Sck and the voltage change of the logical inversion signal SckR at the time when the Pch transistor Tp and the Nch transistor Tn which constitute the analog switch SWk change their state from ON state to OFF state cause the voltage Vsl of the data signal line SLk to rise via respective parasitic capacitances CgdN and CgdP, the following arrangement enables to offer the same advantages as offered by each of the above-escribed embodiment. Specifically, if the change in the voltage Vsl of the data signal line SLk is in the rising direction, a non-inversion delayer obtained by removing the logical inversion function from the inversion delayer 342 is utilized in place of the inversion delayer 342. The non-inversion delayer generates a non-inversion delayed signal, and this signal is supplied to the second terminal of the correction capacitance element Cc. As a consequence, the change amount ΔVcd=VH−VL when the non-inversion delayed signal changes from the H level voltage VH to the L level voltage VL works in the direction to correct the parasitic capacitance roofed data signal line voltage rise ΔVsl. Therefore, in this case again, it is possible to offset the parasitic capacitance rooted data signal line voltage rise ΔVsl by appropriately setting the capacitance value of the correction capacitance element Cc as has been described.

<7. Other Embodiments>

Although each of the above-described embodiments represents an application of the present invention to a liquid crystal display device driven toy an SSD method, the present invention is not limited to any of these; the invention is applicable to liquid crystal display devices which are driven by other methods than SSD method, or other display devices than liquid crystal display devices, as far as the display device is of an arrangement that an analog video signal voltage is sampled and held in the data signal line, and a voltage held in this data signal line is written to a pixel formation portion of the display section.

Figure 35:
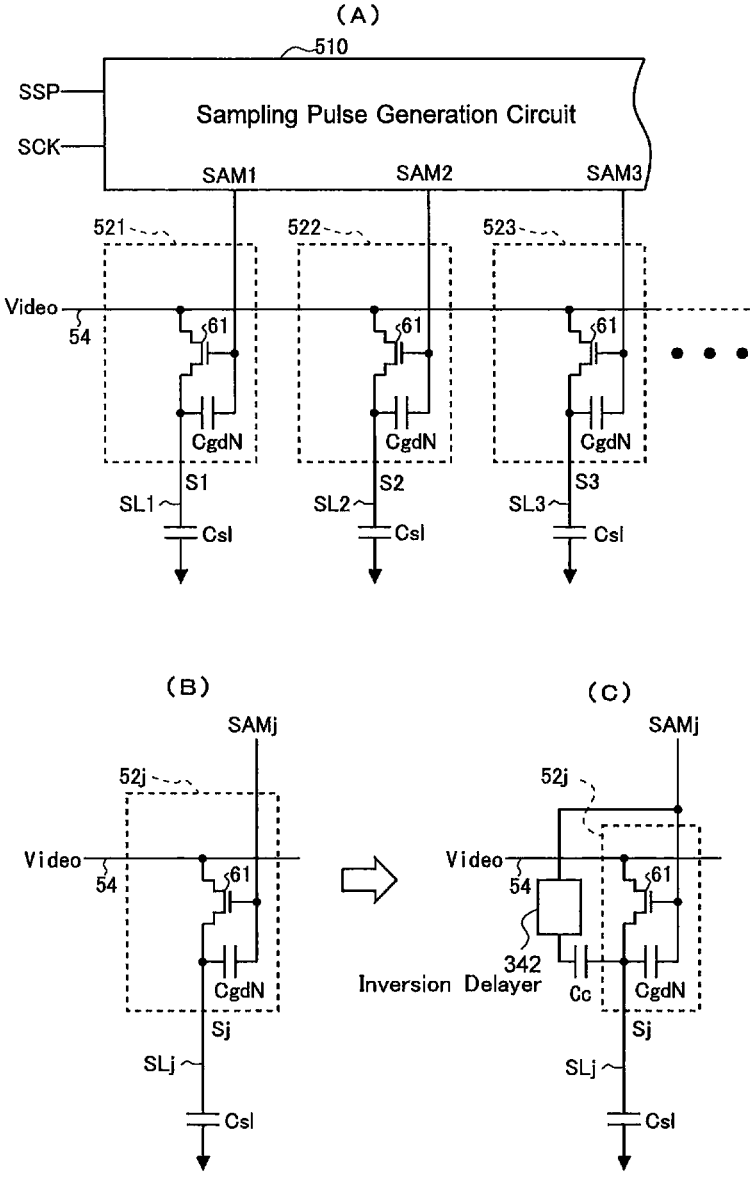
FIG. 35 consists of circuit diagrams (A), (B), and (C) for describing another embodiment of the present invention.

For example, the present invention is applicable to display devices which make use of dot sequential driving method. (A) of FIG. 35 shows a configuration of a data signal line drive circuit and a detailed arrangement of an analog switch section in a dot sequential driving display device to which the present invention is applicable. Other than the arrangements in the data signal line drive circuit, this dot sequential driving display device is configured substantially identically with the first embodiment (see FIG. 1), so the same or corresponding parts or components will be indicated with the same reference symbols, without repeating detailed descriptions thereof.

This data signal line drive circuit includes a sampling pulse generation circuit 510; a plurality of analog switch sections 521, 522, . . . , 52N each corresponding to one of a plurality of data signal lines SL1, SL2, SLN; and a video line 54 to which each of the data signal lines SL1, SL2, . . . , SLN is connected via one of the analog switch sections 521, 522, . . . , 52N. The sampling pulse generation circuit 510 is supplied with a start pulse SSP which assumes H level at intervals of one horizontal period, and a clock signal SCK, whereas the video line 54 is supplied with an analog video signal Video. The sampling pulse generation circuit 510 includes a shift register for sequentially shifting the start pulse SSP from the input end to the output end within each horizontal period in response to the clock signal SCK; and outputs a plurality of sampling signals SAM1, SAM2, . . . , SAMN each becoming active sequentially based on an output signal of each stage of the shift register. These sampling signals SAM1, SAM2, . . . , SAMN correspond to the delta signal lines SL1, SL2, . . . , SLN respectively. Each sampling signal SAMj (j=1, 2, . . . , N) is inputted as a control signal to the analog switch section 52*j* which is connected to the data signal line SLj that corresponds to the sampling signal SAMj. As a consequence, each analog switch section 52*j* assumes ON state when the sampling signal SAMj inputted thereto as the control signal is active, while assuming OFF state when the signal is non-active. Therefore, each data signal line SLj is supplied with the analog video signal Video when the sampling signal SAMj corresponding thereto is active, while electrically being separated from the video line 54 when the signal SAMj is non-active. Since each data signal line SLj has a capacitance Csl like in the first embodiment, the analog video signal Video is sequentially sampled by the sampling signal SAMj and is held by the capacitance (data signal line capacitance) Csl of each data signal line SLi.

(B) of FIG. 35 is a circuit diagram of the dot sequential driving data signal line drive circuit as described above, showing a portion which relates to one data signal line SLj, namely one unit sample-and-holding circuit. The unit sample-and-holding circuit in (B) of FIG. 35 corresponds to the unit sample-and-holding circuit ((A) of FIG. 6) in the first embodiment; and an analog video signal Video and a sampling signal SAMj supplied to this unit sample-and-holding circuit in (B) of FIG. 35 respectively correspond to the video signal Svl and the connection switching control signal Sck supplied to the unit sample-and-holding circuit ((A) of FIG. 6) in the first embodiment. Each analog switch section 52*j* is provided by an Nch transistor 61, and a parasitic capacitance CgdN is formed between the gate terminal of the Nch transistor 61 and the data signal line SLj. Hence, like in the first embodiment, there is a parasitic capacitance rooted data signal line voltage drop also in the unit sample-and-holding circuit.

To solve this problem, the present invention may be applied to correct this data signal line voltage drop by modifying the arrangement in each unit sample-and-holding circuit from the one shown in (B) of FIG. 35 to the one shown in (C) of FIG. 35. The unit sample-and-holding circuit in (C) of FIG. 35 has an inversion delayer 342 and a correction capacitance element Cc like in the first embodiment, and this inversion delayer 342 generates an inversion delayed signal from the sampling signal SAMj, which is then supplied to the data signal line SLj via the correction capacitance element Cc. This provides the same advantages as offered by the first embodiment. In other words, according to the arrangement as described, it is possible to offset the parasitic capacitance rooted data signal line voltage drop at the time of sampling the analog video signal Video, with the voltage change amount of the inversion delayed signal by making an appropriate setting of the capacitance value of the correction capacitance element Cc, thereby reliably and sufficiently suppress the data signal line voltage drop.

Figure 36:
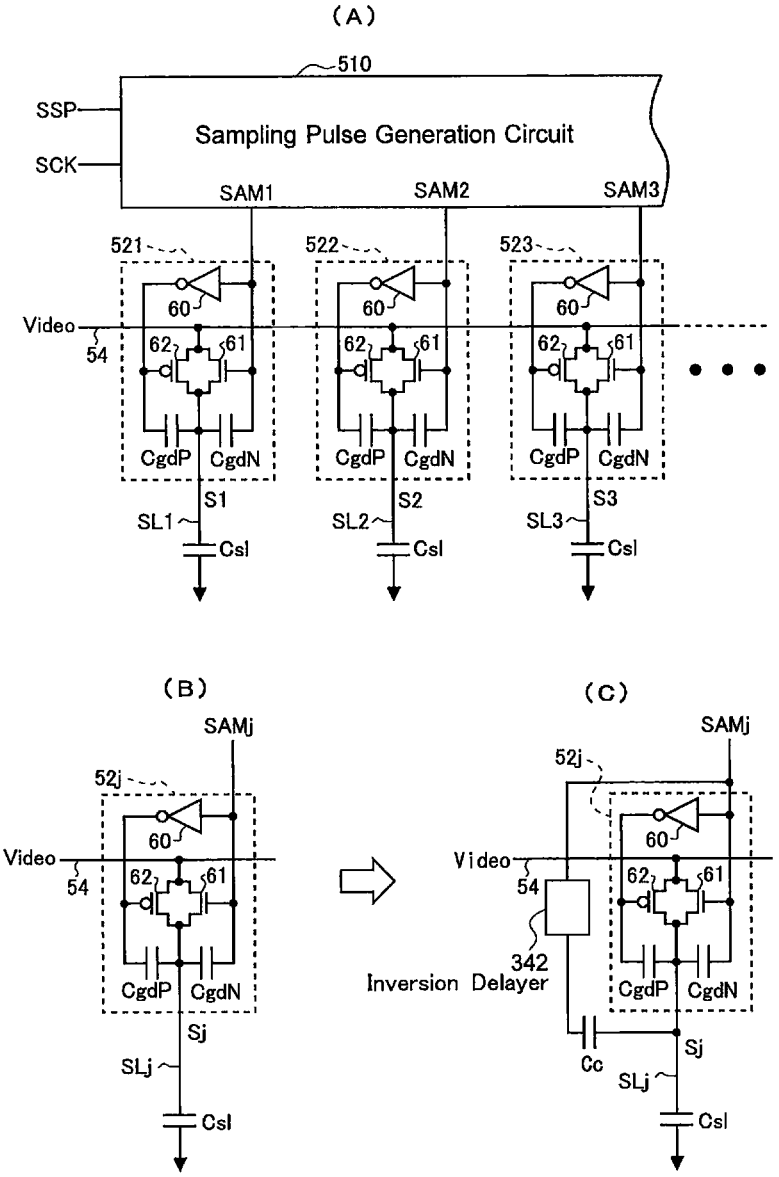
FIG. 36 consists of circuit diagrams (A), (B), and (C) for describing a first variation of the other embodiment.

In the dot sequential driving data signal line drive circuit shown in (A) of FIG. 35, each analog switch section 52*j* is provided only by an Nch transistor 61 (including a parasitic capacitance CgdN); alternatively however, each analog switch section 52*j* may be provided only by a Pch transistor (including a parasitic capacitance CgdP) (j=1 through N). Further alternatively, there may be an arrangement as shown in (A) of FIG. 36, where the analog switch section 52*j* is provided by a CMOS analog switch, i.e., a combination of an Nch transistor 61 and a Pch transistor 62 connected in parallel to each other. In this arrangement, each analog switch section 52*j* includes an inverter 60 for logical inversion of the sampling signal SAMj, the inverter 60 generates a signal by logically inverting the sampling signal SAMj, and the generated signal is supplied to the gate terminal of the Pch transistor. (A) of FIG. 36 shows a configuration of a data signal line drive circuit and a detailed arrangement of an analog switch section in a dot sequential driving display device which has the configuration described as the above. Other than the data signal line drive circuit, the display device is also configured substantially identically with the first embodiment (see FIG. 1), and therefore detailed description will not be repeated here.

(B) of FIG. 36 is a circuit diagram showing a portion which relates to one data signal line SLj, namely one unit sample-and-holding circuit, in the dot sequential driving data signal line drive circuit. The unit sample-and-holding circuit in (B) of FIG. 36 corresponds to the unit sample-and-holding circuit ((A) of FIG. 6) in the first embodiment; and the analog video signal Video and the sampling signal SAMj supplied to this unit sample-and-holding circuit in (B) of FIG. 36 respectively correspond to the video signal Svi and the connection switching control signal Sck supplied to the unit sample-and-holding circuit ((A) of FIG. 6) in the first embodiment. Also, in each analog switch section 52*j*, the Nch transistor 61 is formed with a parasitic capacitance CgdN, whereas the Pch transistor 62 is formed with a parasitic capacitance CgdP. Therefore, like in the unit sample-and-holding circuit of the variation shown in FIG. 34, there can be a parasitic capacitance rooted data signal line voltage drop or rise also in the unit sample-and-holding circuit shown in (B) of FIG. 36.

To correct the data signal line voltage drop or rise by applying the present invention, the same technique as shown in the variation in FIG. 34 can be utilized to change the arrangement of the unit sample-and-holding circuit in the (B) of FIG. 36. For example, in a case where there is a parasitic capacitance rooted data signal line voltage drop, the arrangement in each unit sample-and-holding circuit may be changed from the one shown in (B) of FIG. 36 to the one shown in (C) of FIG. 36. The unit sample-and-holding circuit in (C) of FIG. 36 has an inversion delayer 342 and a correction capacitance element Cc like in the first embodiment, and this inversion delayer 342 generates an inversion delayed signal from the sampling signal SAMj, which is then supplied to the data signal line SLj via the correction capacitance element Cc. This unit sample-and-holding circuit shown in (C) of FIG. 36 is substantially the same as the unit sample-and-holding circuit shown in (A) of FIG. 34 as a variation of each of the preceding embodiments, and makes the same operation as depicted in (B) of FIG. 34 under the same conditions as set forth for the variations. As a result, like in the first embodiment and so on, it is possible to offset the parasitic capacitance rooted data signal line voltage drop at the time of sampling the analog video signal Video, with the voltage change of the inversion delayed signal, thereby reliably and sufficiently suppress the data signal line voltage drop.

Figure 37:
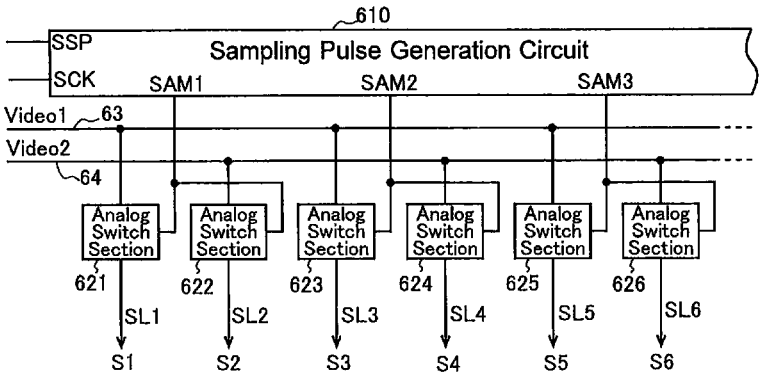
FIG. 37 is a block diagram showing a configuration of a data signal line drive circuit according to a second variation of the other embodiment.
Figure 38:
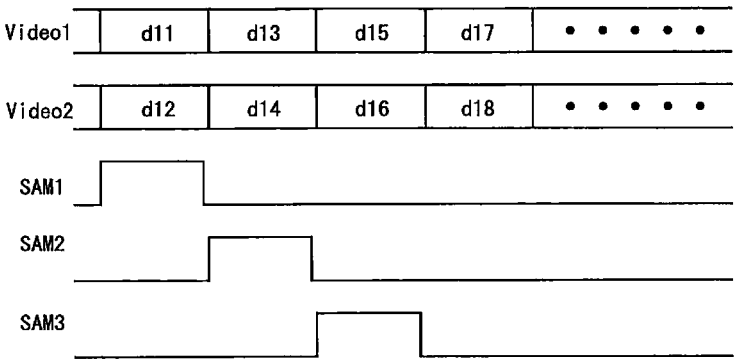
FIG. 38 is a timing chart for describing an operation of a data signal line drive circuit according to the second variation of the other embodiment.

In the dot sequential driving method as described above, an amount of time usable for charging the pixel capacitance in each pixel formation portion is shorter as compared to the line sequentially driving method. Consequently, in cases where display image has a high resolution, there can be cases where the proper voltage (voltage of the analog video signal Video) cannot be held in the pixel capacitance, in other words, there can be cases where the pixel capacitance is not sufficiently charged. As a solution to this, there is known a display device which makes use of a method where a sufficient time is ensured for charging the pixel capacitance by extending the sampling cycle through time-scale expansion of the analog video signal (this method is sometimes called "phase expansion method", etc.) In the phase expansion method, the analog video signal undergoes time-scale expansion by a multiplier of p (p represents 2 or a greater integer) to obtain a signal (called "p-phase expansion signal"), which is then supplied to the data signal line drive circuit using as many as p video lines. The present invention is applicable to such a phase expansion display device as the above, as follows:

FIG. 37 is a block diagram showing a configuration of a data signal line drive circuit in a phase expansion display device. FIG. 38 is a timing chart for describing an operation of the data signal line drive circuit in this phase expansion display device. This data signal line drive circuit includes a sampling pulse generation circuit 610, two video lines 63, 64, and analog switch sections 62*j* each corresponding to one of data signal lines SLj (j=1 through H). Other than the arrangements in the data signal line drive circuit, this phase expansion display device is configured basically identically with the first embodiment (see FIG. 1), so the same or corresponding parts or components will be indicated with the same reference symbols, without repeating detailed descriptions thereof. It should be noted here that FIG. 38 includes a symbol dij associated with two phase expansion signals Video1, Video2 as analog video signals. The symbol dij denotes the pixel data to be written to the pixel formation portion 10 (pixel capacitance Cp thereof) which is connected to the i-th scanning signal line GLi and the j-th data signal line SLj (i=1 through m, j=1 through 3*n*).

In this phase expansion display device, time-scale expansion of the analog video signal by a multiplier of two generates two phase expansion signals Video1, Video2 in the display control, circuit (unillustrated), which are then supplied to two video lines 63, 64 routed in the data signal line drive circuit. As a result, the analog video signal, (two phase expansion signals Video1, Video2) are sampled with a cycle twice as long as in the dot sequential driving data signal line drive circuit shown in FIG. 35 or FIG. 36. However, each analog switch section 62*j* for this sampling has the same configuration as the analog switch 52*j* data signal line drive circuit shown in FIG. 35 or FIG. 36 (j=1 through N). Therefore, this phase expansion data signal line drive circuit (FIG. 37) is also subject to such problems as parasitic capacitance rooted data signal line voltage drop. Therefore, the present invention may be applied also to this phase expansion data signal line drive circuit (FIG. 37) to correct such problems as the data signal line voltage drop; specifically, each unit sample-and-holding circuit can be modified from the arrangement shown in (B) of FIG. 35 to the arrangement shown in (C) of FIG. 35, or from the arrangement shown in (B) of FIG. 36 to the arrangement shown in (C) of FIG. 36. Through this modification, like in the first embodiment and so on, it becomes possible to offset such a voltage variation as the parasitic capacitance rooted data signal line voltage drop at the time of sampling the analog video signal (two phase expansion signals Video1, Video2), with the voltage change of the inversion delayed signal, thereby reliably and sufficiently suppress such a voltage variation as the data signal line voltage drop.

INDUSTRIAL APPLICABILITY

The present invention is applicable: to a data signal line drive circuit which includes analog switches for applying analog video signals to a plurality of data signal lines respectively and causing the data signal lines to hold the analog video signals respectively, the data signal lines being connected to a plurality of pixel formation portions for formation of an image to be displayed; and to a display device including the same. The present invention is particularly suitable for such a display device as having a data signal line drive circuit described as the above and a non-rectangular display section.

DESCRIPTION OP REFERENCE CHARACTERS

10: Pixel formation portion
12: TFT (Thin Film Transistor)
100: Display Panel
120: Display Section (Display Region)
200: Scanning Signal Lines Drive Circuit (Gate Driver)
300: Data Signal Line Drive Circuit (Source Driver)
310: Data Signal Generation Circuit
320: Demultiplexing Circuit (Sampling Circuit)
322: Demultiplexer
330: Correction Circuit
340: Inversion Delaying Circuit
342: Inversion Delayer
350: Correction Capacitance Circuit
400: Display Control Circuit
Cc: Correction Capacitance Element
Cgd: Parasitic capacitance
Csl: Data Signal Line Capacitance
SW1, SW2, SW3: Analog Switches (Transistors)
GL1 through GLm: Scanning Signal Lines (Gate Lines)
SL1 through SL3*n:* Data Signal Lines (Source tines)
S1 through S3*n:* Data Signals
Sc1, Sc2, Sc3: Connection Switching Control Signals (Analog Switch Control Signals)
Srd1, Srd2, Srd3: Inversion Delayed signals
Sv1 through Svn: Video Signals (Analog Video Signals)
VH: H level voltage (ON Voltage, First-level Voltage)
VL: L level voltage (OFF Voltage, Second-level Voltage)

The invention claimed is:

1. A data signal line drive circuit provided with analog switches for applying analog video signals to a plurality of data signal lines respectively and causing the plurality of data signal lines to hold the analog video signals respectively, the plurality of data signal lines being connected to a plurality of pixel formation portions for formation of an image to be displayed, the circuit comprising:

an analog switch provided for each of the plurality of data signal lines and including a field effect transistor having: a first conduction terminal for receiving an analog video signal to be applied to one of the pixel formation portions connected to a corresponding one of the data signal lines; a second conduction terminal connected to the corresponding data signal line; and a control terminal for receiving a control signal for switching between an ON state and an OFF state;

a correction capacitance element including a first terminal connected to the corresponding data signal line; and an inversion delaying circuit configured to generate an inversion delayed signal and apply the inversion delayed signal to a second terminal of the correction capacitance element, the inversion delayed signal being generated by logically inverting the control signal while delaying the control signal for a predetermined time in accordance with a length of time from a time point at which the control signal starts its change from a first-level voltage for bringing the transistor into an ON state to a second-level voltage for bringing the transistor into an OFF state to a time point at which the transistor assumes the OFF state.

2. The data signal line drive circuit according to claim 1, wherein the inversion delaying circuit generates the inversion delayed signal so that the inversion delayed signal starts its change from the second-level voltage to the first-level voltage after the transistor assumes the OFF state, when the transistor is turned OFF.

3. The data signal line drive circuit according to claim 2, wherein the inversion delaying circuit generates the inversion delayed signal so that the inversion delayed signal starts its change from the second-level voltage to the first-level voltage after the control signal reached the second-level voltage, when the transistor is turned OFF.

4. The data signal line drive circuit according claim 1, wherein the capacitance value of the correction capacitance element is a predetermined value based on: a parasitic capacitance between the control terminal and the second conduction terminal of the transistor; a difference between the first-level voltage and the second-level voltage; and a voltage of the control signal at which the transistor assumes the OFF state when the control signal changes from the first-level voltage toward the second-level voltage.

5. The data signal line drive circuit according claim 1, wherein the inversion delaying circuit includes three or a greater odd number of mutually cascade-connected inverters.

6. The data signal line drive circuit according claim 1, wherein the inversion delaying circuit includes an inversion delayer having at least one Schmitt trigger inverter and configured to generate the inversion delayed signal from the control signal.

7. The data signal line drive circuit according claim 6, wherein the Schmitt trigger inverter in the inversion delaying circuit includes a transistor having a multi-gate structure.

8. The data signal line drive circuit according claim 1, wherein the inversion delaying circuit is provided for each data signal line.

9. The data signal line drive circuit according claim 1, wherein the analog switch is disposed on one end of the corresponding data signal line, and the correction capacitance element is disposed on another end of the corresponding data signal line.

10. The data signal line drive circuit according claim 1, wherein the plurality of data signal lines are grouped into a plurality of data signal line groups, each group including two or a greater predetermined number of data signal lines, the inversion delaying circuit includes a predetermined number of inversion delayers respectively corresponding to the predetermined number of data signal lines, and each of the predetermined number of inversion delayers receives a control signal which is to be applied to one of the analog switches connected to a corresponding one of the predetermined number of data signal lines which constitute each data signal line group; generates an inversion delayed signal from the control signal; and applies the inversion delayed signal to the second terminal of the correction capacitance element connected to the corresponding data signal line.

11. The data signal line drive circuit according claim 10, wherein the predetermined number of inversion delayers are disposed in such a manner as to be distributed on one and another ends in a direction perpendicular to a direction in which the plurality of data signal lines extend in the data signal line drive circuit.

12. The data signal line drive circuit according claim 1, wherein the correction capacitance element is constituted by: a predetermined portion of an insulation layer which is formed to make a gate insulation film of the transistor; a predetermined portion of a conductive layer which is formed to make a gate electrode of the transistor; and a predetermined portion of a semiconductor layer which is formed to make a channel region of the transistor.

13. A display device having a display section provided with a plurality of data signal lines; a plurality of scanning signal lines across the plurality of data signal lines; and a plurality of pixel formation portions disposed in a matrix pattern along the plurality of data signal lines and the plurality of scanning signal lines; the display device comprising:

the data signal line drive circuit according to claim 1; and a scanning signal lines drive circuit configured to selectively drive the plurality of scanning signal lines.

14. The display device according to claim 13, wherein the analog switch is disposed at one end of the corresponding data signal line, and the correction capacitance element is disposed on another end of the corresponding data signal line.

15. The display device according to claim 13, wherein the plurality of data signal lines are grouped into a plurality of data signal line groups, each group including two or a greater predetermined number of data signal lines, the inversion delaying circuit includes a predetermined number of inversion delayers respectively corresponding to the predetermined number of data signal lines, each of the predetermined number of inversion delayers receives a control signal which is to be applied to the analog switch connected to a corresponding one of the predetermined number of data signal lines which constitute each data signal line group; generates an inversion delayed signal from the received control signal; and applies the generated inversion delayed signal to the other terminal of the correction capacitance element connected to the corresponding data signal line; and the predetermined number of inversion delayers are disposed in such a manner as to be distributed on one and another ends in a direction perpendicular to a direction in which the plurality of data signal lines extend in the data signal line drive circuit.

16. The display device according to claim 13, wherein the display section is non-rectangular, and at least two data signal lines of the plurality of data signal lines differ from each other in length, in accordance with the shape of the display section.

17. A data signal line drive method by means of a data signal line drive circuit provided with analog switches for applying analog video signals to a plurality of data signal lines respectively and causing the plurality of data signal lines to hold the analog video signals respectively, the plurality of data signal lines being connected to a plurality of pixel formation portions for formation of an image to be displayed, the method comprising:

a step of applying an analog video signal via an analog switch to one data signal line of the plurality of data signal lines;

a step of turning the analog switch into an OFF state by changing a level of a control signal supplied to the analog switch after supplying said one data signal line with the analog video signal via the analog switch;

a step of generating an inversion delayed signal by logically inverting the control signal while delaying the control signal for a predetermined time in accordance with a length of time from a time point at which the control signal starts its change from a first-level voltage for bringing the analog switch into an ON state to a second-level voltage for bringing the analog switch into an OFF state to a time point at which the transistor assumes the OFF state; and a step of supplying the inversion delayed signal to the said one data signal line via a correction capacitance element.

* * * * *